US007322912B2

(12) United States Patent
Hockemeyer

(10) Patent No.: US 7,322,912 B2
(45) Date of Patent: Jan. 29, 2008

(54) WEIGHTLIFTING BENCH WITH ADJUSTABLE HEADREST

(75) Inventor: Timothy John Hockemeyer, Midland, MI (US)

(73) Assignee: Rogers Athletic Company, Clare, MI (US)

( * ) Notice: Subject to any disclaimer, the term of this patent is extended or adjusted under 35 U.S.C. 154(b) by 85 days.

(21) Appl. No.: 11/326,071

(22) Filed: Jan. 5, 2006

(65) Prior Publication Data

US 2007/0155605 A1 Jul. 5, 2007

(51) Int. Cl.
*A63B 26/00* (2006.01)

(52) U.S. Cl. ..... 482/142

(58) Field of Classification Search ..... 482/142; D21/676, 686, 690

See application file for complete search history.

(56) References Cited

U.S. PATENT DOCUMENTS 4,861,024 A 8/1989 Lee
5,215,510 A 6/1993 Baran
5,669,859 A 9/1997 Liggett et al.
5,743,832 A * 4/1998 Sands et al. ..... 482/52
D444,827 S 7/2001 Mobley
6,605,023 B1 8/2003 Mobley
6,623,407 B2 9/2003 Novak et al.
6,623,409 B1 9/2003 Abelbeck
6,669,607 B2 12/2003 Slawinski et al.
6,893,096 B2 * 5/2005 Bonn et al. ..... 297/409

* cited by examiner

*Primary Examiner*—Lori Amerson
(74) *Attorney, Agent, or Firm*—Carlson, Gaskey & Olds

(57) ABSTRACT

A weight bench system includes an adjustable headrest assembly. The adjustable headrest assembly is movable from a position flat with a backrest assembly to a multitude of articulated positions. To reset the headrest assembly back to the flat position, the headrest assembly is articulated to a fully articulated position, then returned to the flat position.

17 Claims, 25 Drawing Sheets

WEIGHTLIFTING BENCH WITH ADJUSTABLE HEADREST

BACKGROUND OF THE INVENTION

The present invention relates to weightlifting equipment, and more particularly to a weight bench with a headrest adjustable separate from a backrest.

Weightlifters perform various exercises for the purpose of developing particular muscles throughout the body. These exercises can be performed through the use of free weights, such as barbells, or with machines. Many weightlifters prefer free weights because free weights permit the lifter to perform the exercises in a natural motion while utilizing pure body leverage in performing the exercise. This facilitates isolation of particular muscle groups and simulates actual athletic sports motions.

Oftentimes when utilizing free weights in combination with a weight bench, the backrest and the seat of the weight bench are articulated to perform particular exercises. As the backrest of conventional weight benches are generally planar members, the weight bench may not provide proper head support for the weightlifter.

Accordingly, it is desirable to provide a weight bench which may be adjusted to have a proper head position.

SUMMARY OF THE INVENTION

A weight bench system according to the present invention includes an adjustable headrest assembly. The adjustable headrest assembly is movable from a position flat with a backrest assembly to a multitude of tilted positions. To reset the headrest assembly back to the flat position, the headrest assembly is articulated to a fully articulated position, then tilted back to the flat position.

A hanging lock pin engages an opening within a guide plate of the headrest assembly. The hanging lock pin is center spring loaded such that as the headrest assembly is articulated through from the flat position, the hanging lock pin remains spring loaded forward. When the headrest assembly reaches the fully articulated position, the hanging lock pin is moved rearward within the guide plate opening until the hanging lock pin goes over center and becomes spring loaded in a rearward direction. The headrest assembly may then be tilted back to the flat position. As the headrest assembly reaches the flat position, the lock pin is again forced forward within the guide plate opening during the last portion of the travel such that the hanging lock pin again goes over center and is now spring loaded forward ready to be adjusted to the articulated positions once again.

The present invention therefore provides a weight bench which may be adjusted to have a proper head position.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1A:
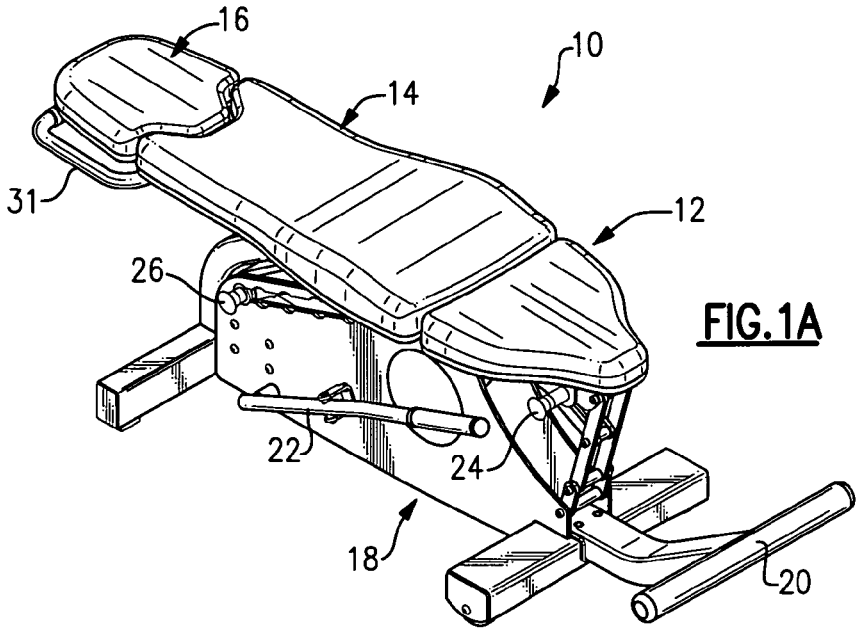
FIG. 1A is a perspective view of the weight bench system.
Figure 1C:
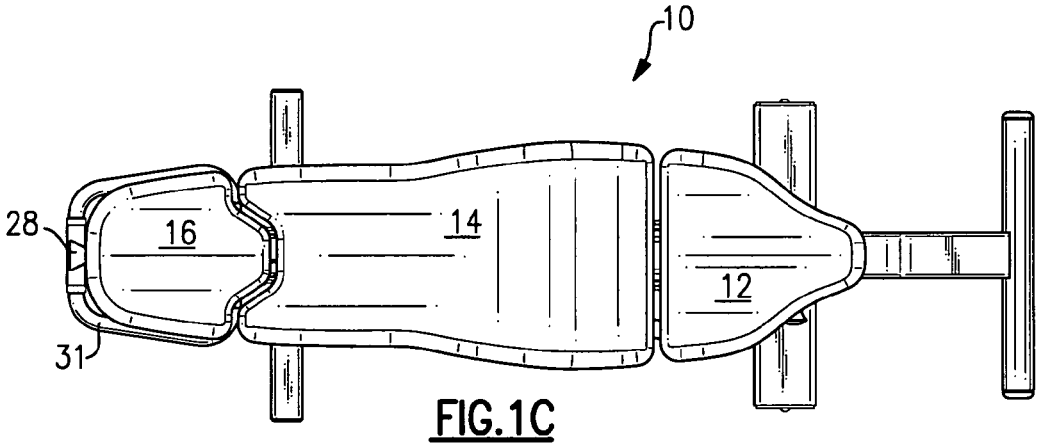
FIG. 1C is a top view of the weight bench system.
Figure 1B:
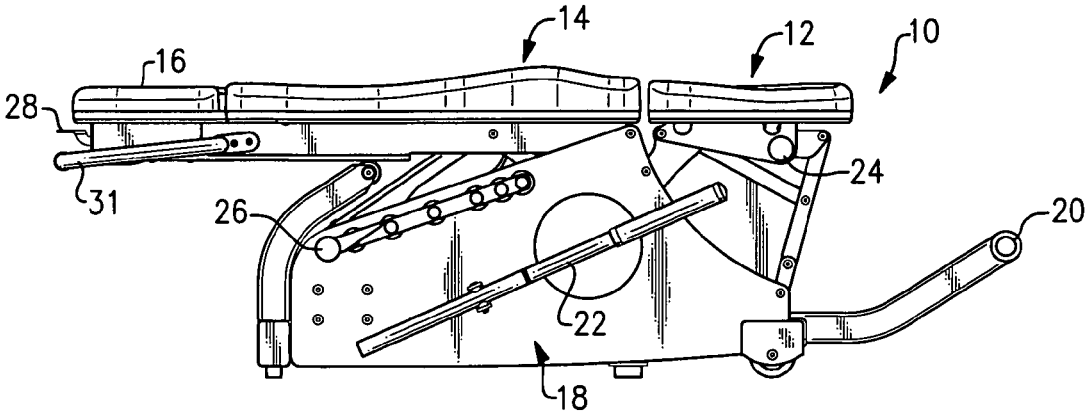
FIG. 1B is a side view of the weight bench system.

FIGS. 1A-1C illustrate views of a weight bench system 10 with a separately adjustable seat assembly 12, an adjustable backrest assembly 14 and an adjustable headrest assembly 16. The seat assembly 12, backrest assembly 14 and headrest assembly 16 are mounted to a frame assembly 18 that may include a foot rest 20.

A fore/aft lever assembly 22, a seat adjustment pin assembly 24, and a backrest adjustment pin assembly 26 provides for significant adjustment of the weight bench system 10. Preferably, a remote handle assembly 28 (illustrated in FIGS. 1B and 1C) adjacent a handle bar 31 on the backrest assembly 14 provides for remote one-hand operation of the backrest adjustment pin assembly 26 such that the backrest assembly 14 may be articulated with one hand from an advantageously accessible position behind the weight bench system 10.

Figure 2A:
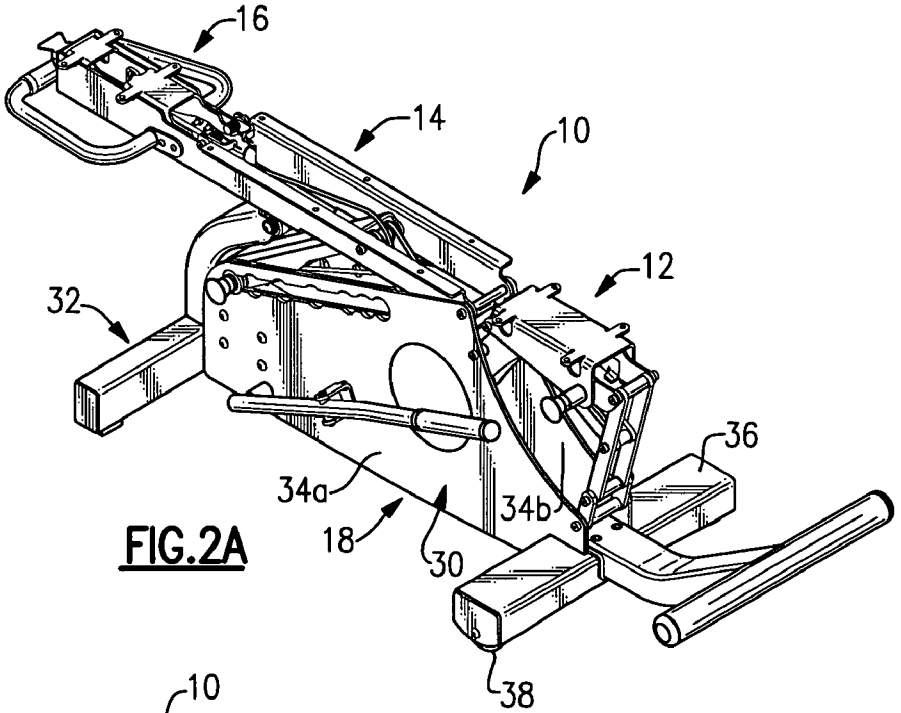
FIG. 2A is a perspective view of the weight bench system with the cushions removed.
Figure 2B:
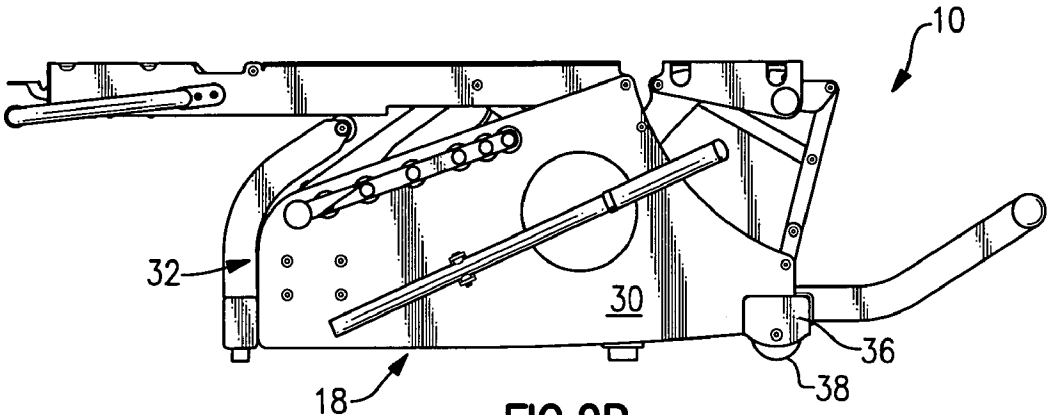
FIG. 2B is a side view of the weight bench system with the cushions removed.

Referring to FIGS. 2A and 2B, the frame assembly 18 includes a base assembly 30 and a rear leg assembly 32. The base assembly 30 includes a first frame plate 34*a*, a second frame plate 34*b* and a transverse front leg 36. The transverse front leg 36 preferably includes rollers 38 to facilitate movement of the weight bench system 10.

Figure 3:
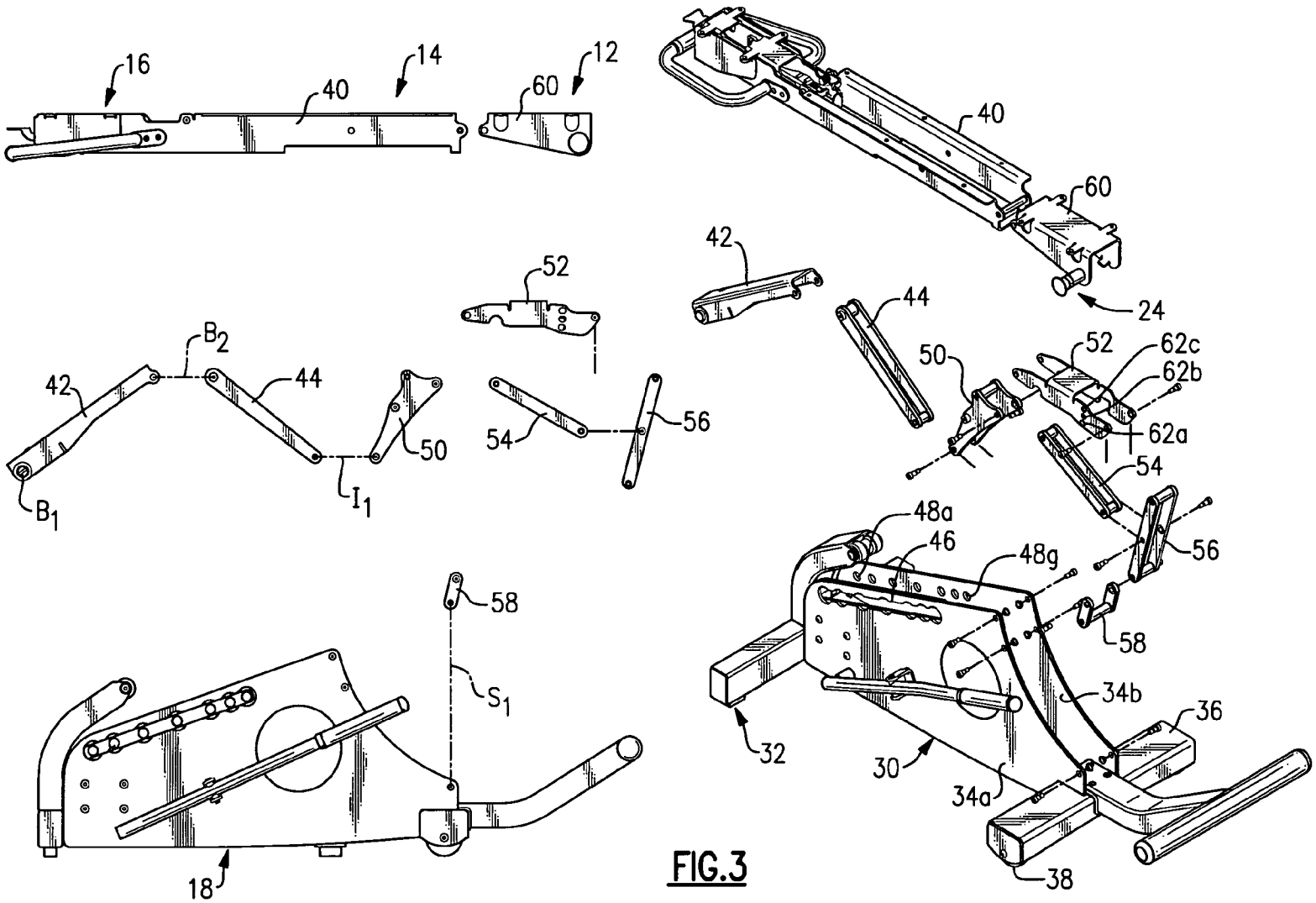
FIG. 3 is an exploded view of the weight bench system illustrating the backrest assembly linkage and the seat assembly linkage.

Referring to FIG. 3, the backrest assembly 14 supports the head rest assembly 16. The backrest assembly 14 further includes a backrest cushion frame 40, a rear backrest link 42 and a forward backrest link 44. The rear backrest link 42 is pivotally mounted within the frame assembly 18 between the frame plates 34*a*, 34*b* at a backrest pivot axis B1 (FIG. 4) defined by the seat adjustment pin assembly 24. The rear backrest link 42 receives the seat adjustment pin assembly 24 for movement within an adjustment slot 46 in the first frame plate 34*a* for engagement with a multiple of adjustment apertures 48A-48G in the second frame plate 34*b* as will be further described.

An opposite end segment of the rear backrest link 42 is pivotally attached to the forward backrest link 44 at a backrest pivot axis B2 (FIG. 4) which may be defined by a fastener, pivot pin or the like. It should be understood that various axles or pivot pin arrangements which attach the two components together while providing pivotal movement about the axis may also be utilized with the present invention.

The forward backrest link 44 is pivotally mounted to an intermediate link 50 at an intermediate pivot axis I1 which may be defined by a fastener, pivot pin or the like. The intermediate link 50 is the interface between the backrest assembly 14 and the seat assembly 12.

Figure 4:
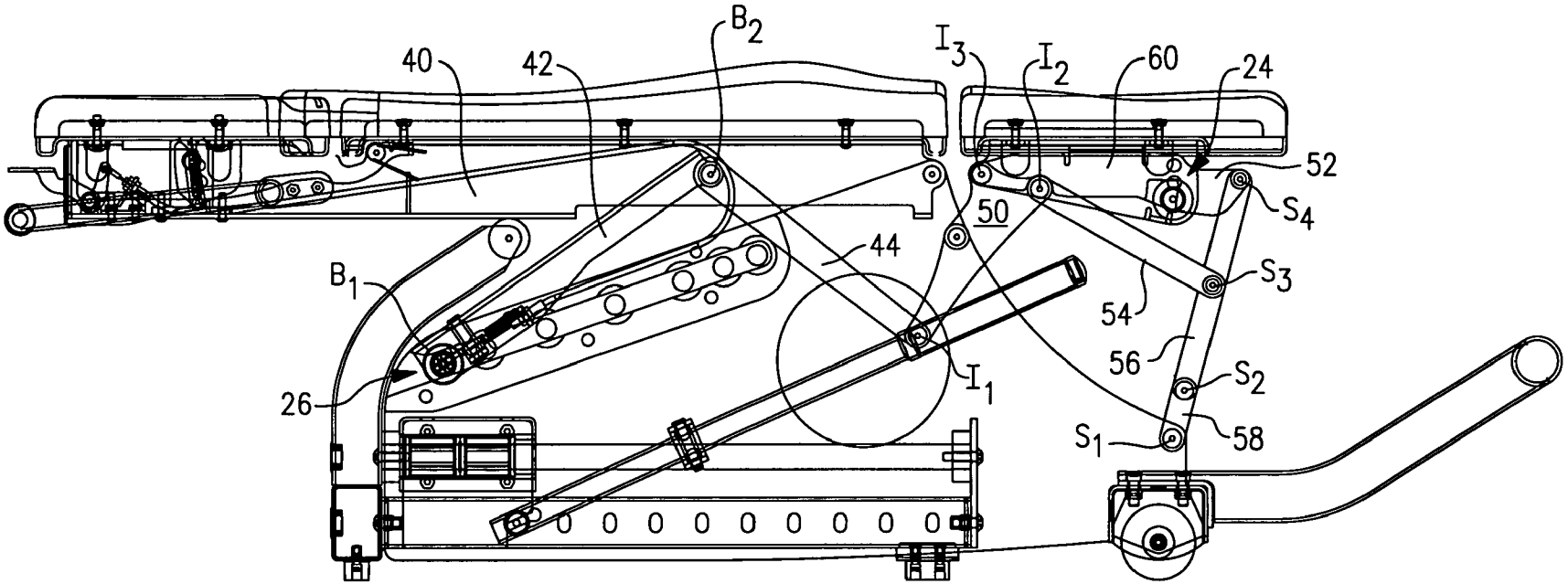
FIG. 4 is a side view of the weight bench system illustrating the pivot axes of the linkages illustrated in FIG. 3.
Figure 5A:
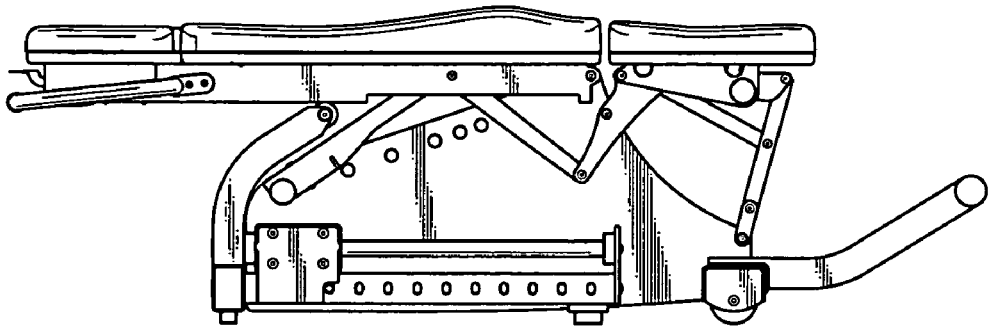
FIGS. 5A-5G show the weight bench system with the backrest in various articulated positions.
Figure 5B:
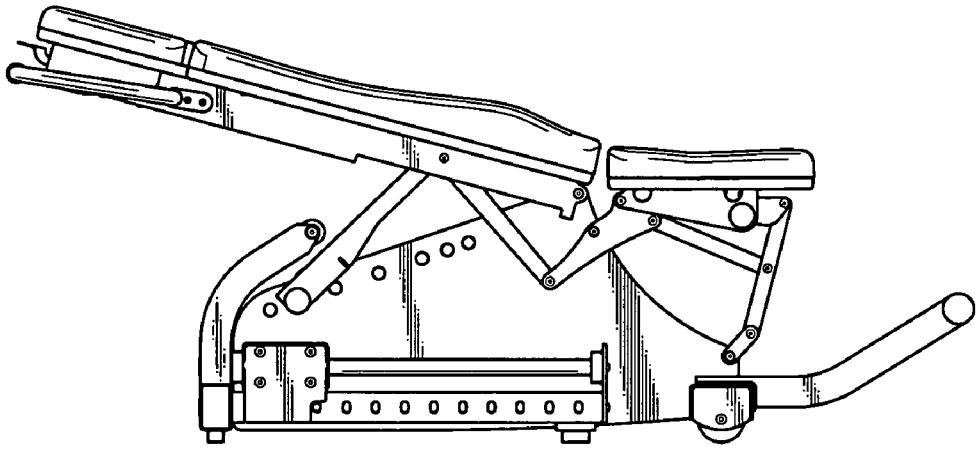
Figure 5C:
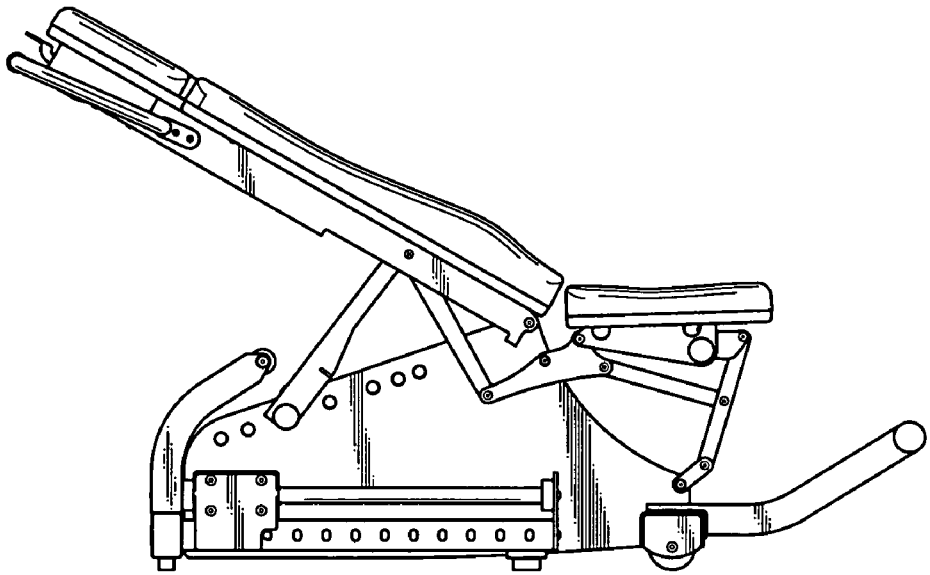
Figure 5D:
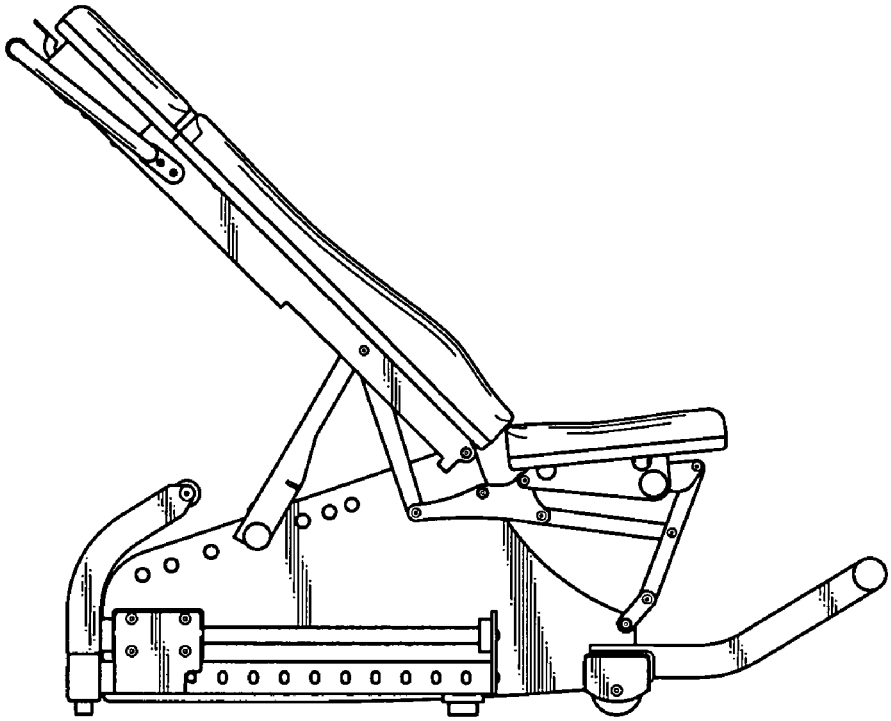
Figure 5E:
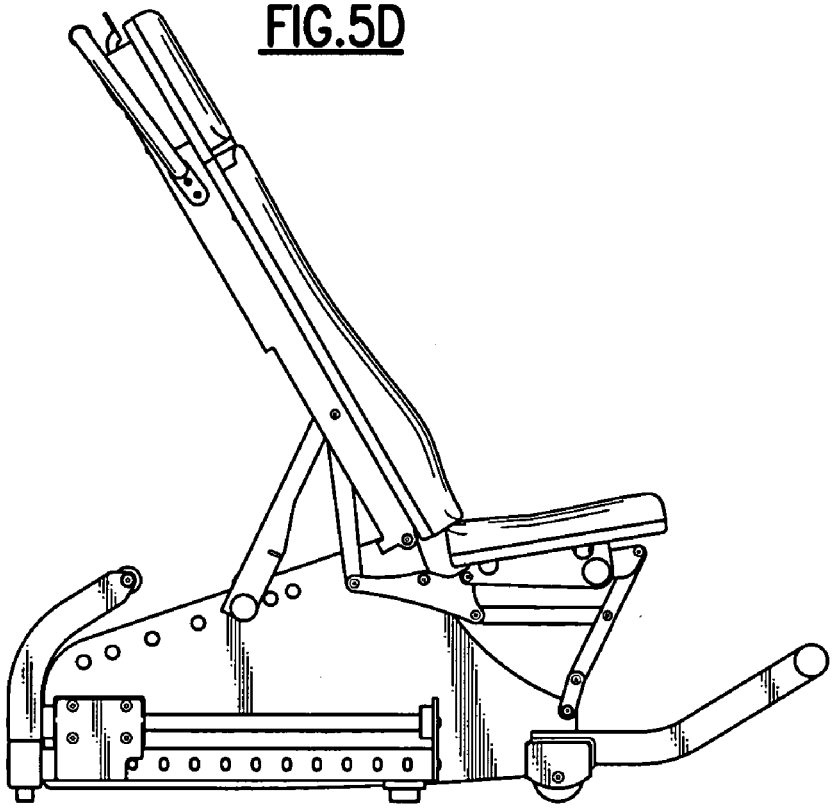
Figure 5F:
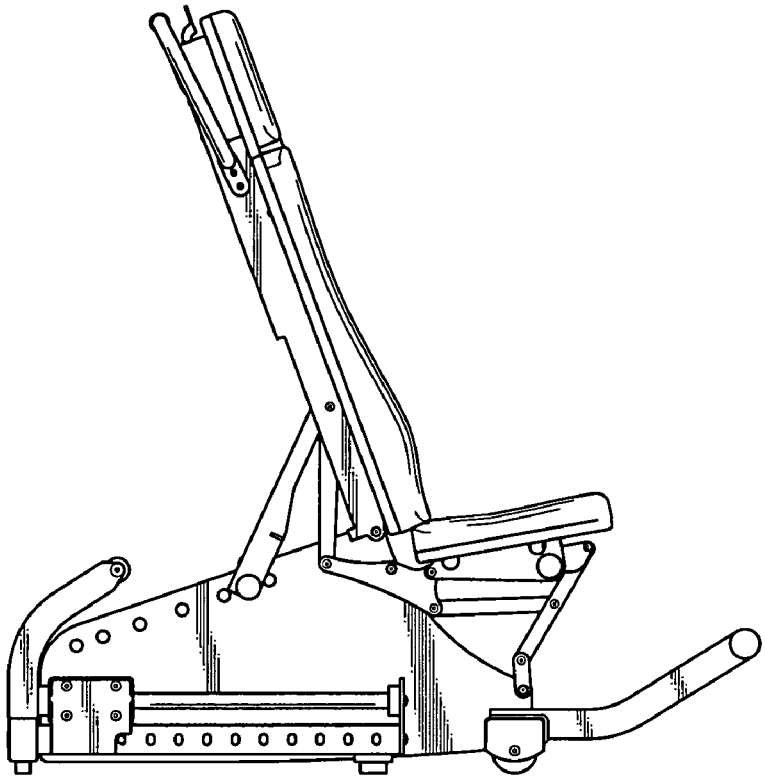
Figure 5G:
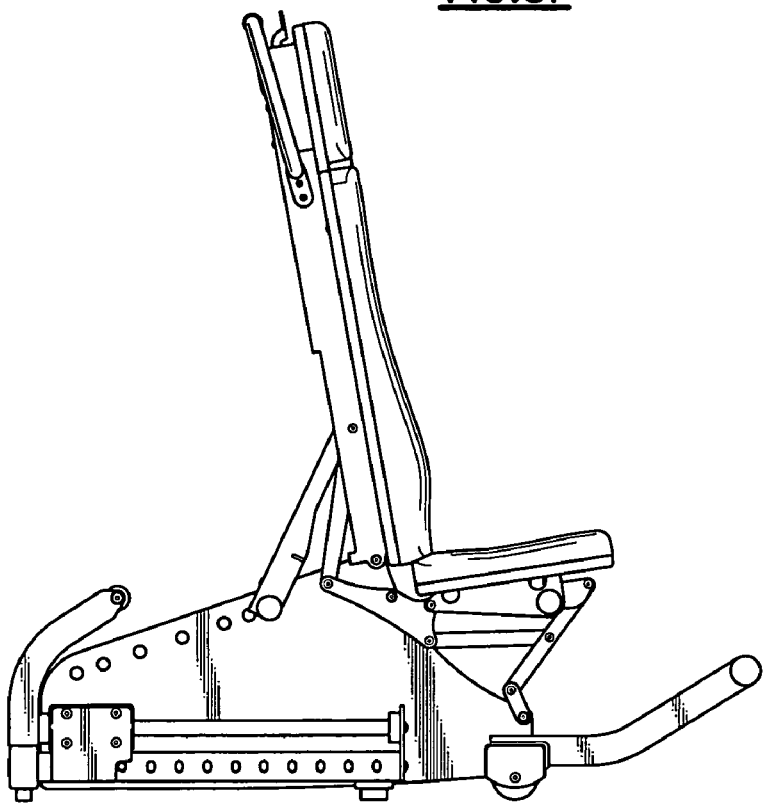

The seat assembly 12 includes a seat cushion frame support link 52, a seat link 54, an intermediate seat link 56 and a forward seat link 58 and a seat cushion frame 60. The forward seat link 58 is mounted within the frame assembly 18 between the frame plates 34*a*, 34*b* at a seat pivot axis S1 which may be defined by a fastener, pivot pin or the like. The forward seat link 58 is pivotally mounted to the intermediate seat link 56 at a seat pivot axis S2 (FIG. 4). The intermediate seat link 56 is pivotally mounted to the seat link 54 at a seat pivot axis S3 and the seat cushion frame support link 52 at a seat pivot axis S4 (FIG. 4). That is, the seat axes S2, S3, S4 are defined by the intermediate seat link 56 with the seat pivot axis S3 intermediate the seat pivot axes S2, S4. The seat link 54 is pivotally mounted to the intermediate link 50 at an intermediate pivot axis I2 which may be defined by a fastener, pivot pin or the like.

The seat cushion frame support link 52 is also pivotally mounted to the intermediate link 50 at an intermediate pivot axis I3 (FIG. 4) which may be defined by a fastener, pivot pin or the like. A seat cushion frame 60 is pivotally mounted to the seat cushion frame support link 52 at the intermediate pivot axis I3 such that the seat cushion frame 60 may be adjusted relative the seat cushion frame support link 52.

The seat cushion frame 60 may be adjusted relative the seat cushion frame support link 52 and locked into place by the seat adjustment pin assembly 24. The seat cushion 60 may be adjusted by selectively engaging the seat adjustment pin assembly 24 into one of a multitude of apertures 62*a*-62*c* defined within the seat cushion frame. Preferably, the seat cushion frame 60 may be adjusted in five (5) degree increments to a plus five and plus ten degree position relative the seat cushion frame support link 52, however, any number of adjustments at various increments may also be utilized with the present invention.

The adjustable seat assembly 12 and the adjustable backrest assembly 14 provide synchronized movement as illustrated in FIGS. 5A-5G. There are seven different back angle positions (0 degrees, 15, 30, 45, 60, 70, and 80) each associated with a position of the backrest adjustment pin assembly 26 which moves within the adjustment slot 46 in the first frame plate 34*a* for engagement with the multiple of adjustment apertures 48A-48G in the second frame plate 34*b*. It should be understood that each aperture 48A-48G is associated with a position of the backrest position (FIGS. 5A-5G). It should be understood that any number or positions may also be utilized with the present invention.

A unique feature of the adjustable seat assembly 12 and the adjustable backrest assembly 14 linkage is that the seat cushion frame 60 remains in a comfortable position relative to the backrest cushion frame 40 in all back angle positions. In other words, the angle between the seat assembly 12 and the backrest assembly 14 is reduced at a slower rate. For example, when the backrest cushion frame 40 of the backrest assembly 14 is at 80 degrees (FIG. 5G), the angle between the seat cushion frame 60 and backrest cushion is 91 degrees. As the forward seat link 58 is pivotally mounted to the intermediate seat link 56 at the seat pivot axis S2, the seat pivot axis S2 transits first forward (FIGS. 5A-5C) until approximately the thirty degree position (FIG. 5C) then reverse aft toward the seat cushion frame for the remainder of the backrest cushion frame 40 movement (FIGS. 5C-5G). Such movement thereby maintains the advantageous relationship.

Figure 6:
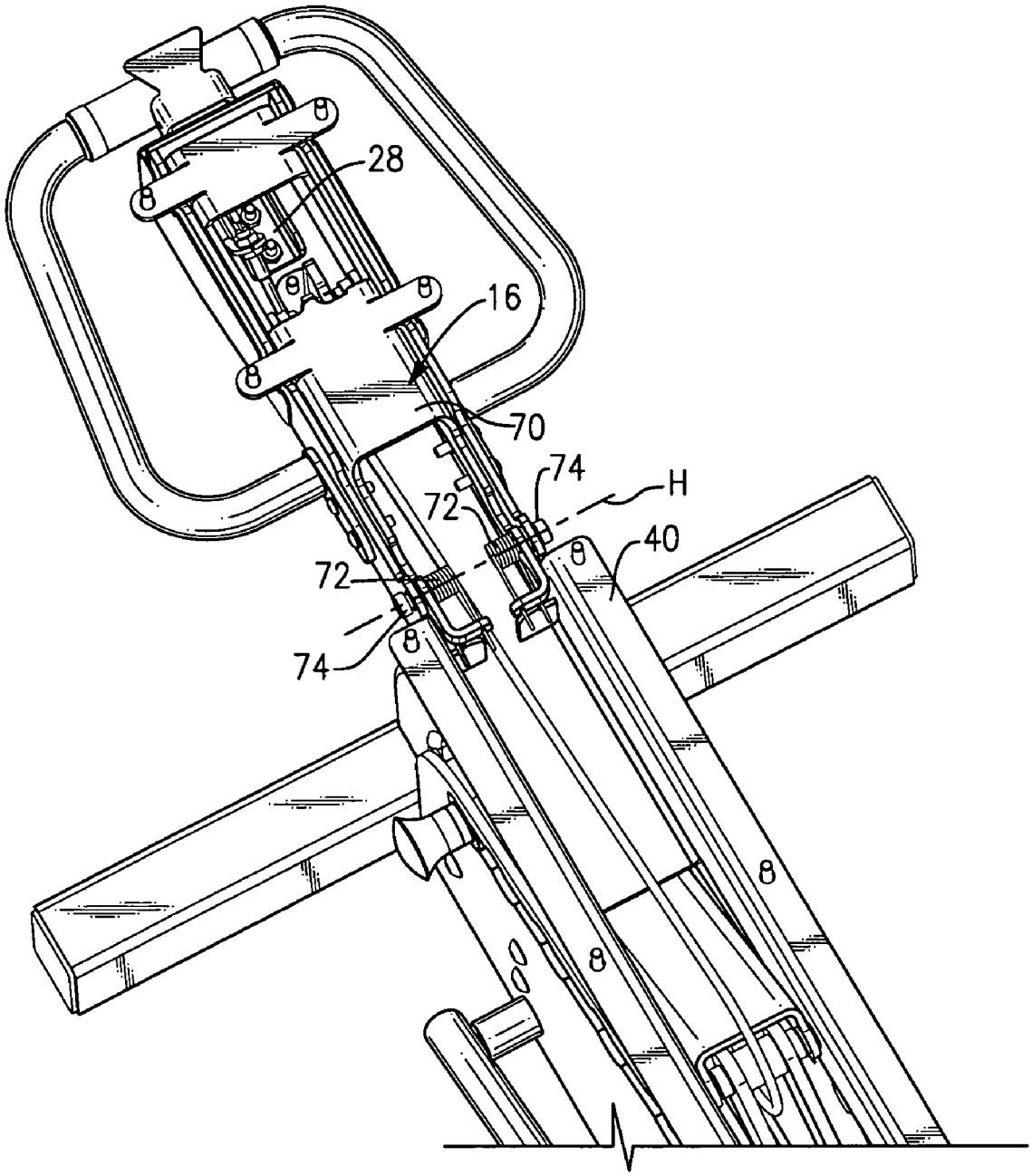
FIG. 6 is an expanded perspective view of the headrest assembly of the weight bench system.

Referring to FIG. 6, the adjustable headrest assembly 16 is located within the backrest cushion frame 40. The adjustable headrest assembly 16 generally includes a headrest cushion frame 70 (also illustrated in FIG. 7A) which fits within the backrest cushion frame 40 preferably at least partially around the remote handle assembly 28. The headrest cushion frame 70 is pivotally mounted to the backrest cushion frame 40 at a headrest pivot axis H. The headrest cushion frame 70 is biased in a direction toward the backrest cushion frame 40 by a set of springs 72 which are preferably mounted on fasteners 74 along the axis of rotation H. It should be understood that various pivot assemblies may alternatively or additionally be utilized.

Figure 7A:
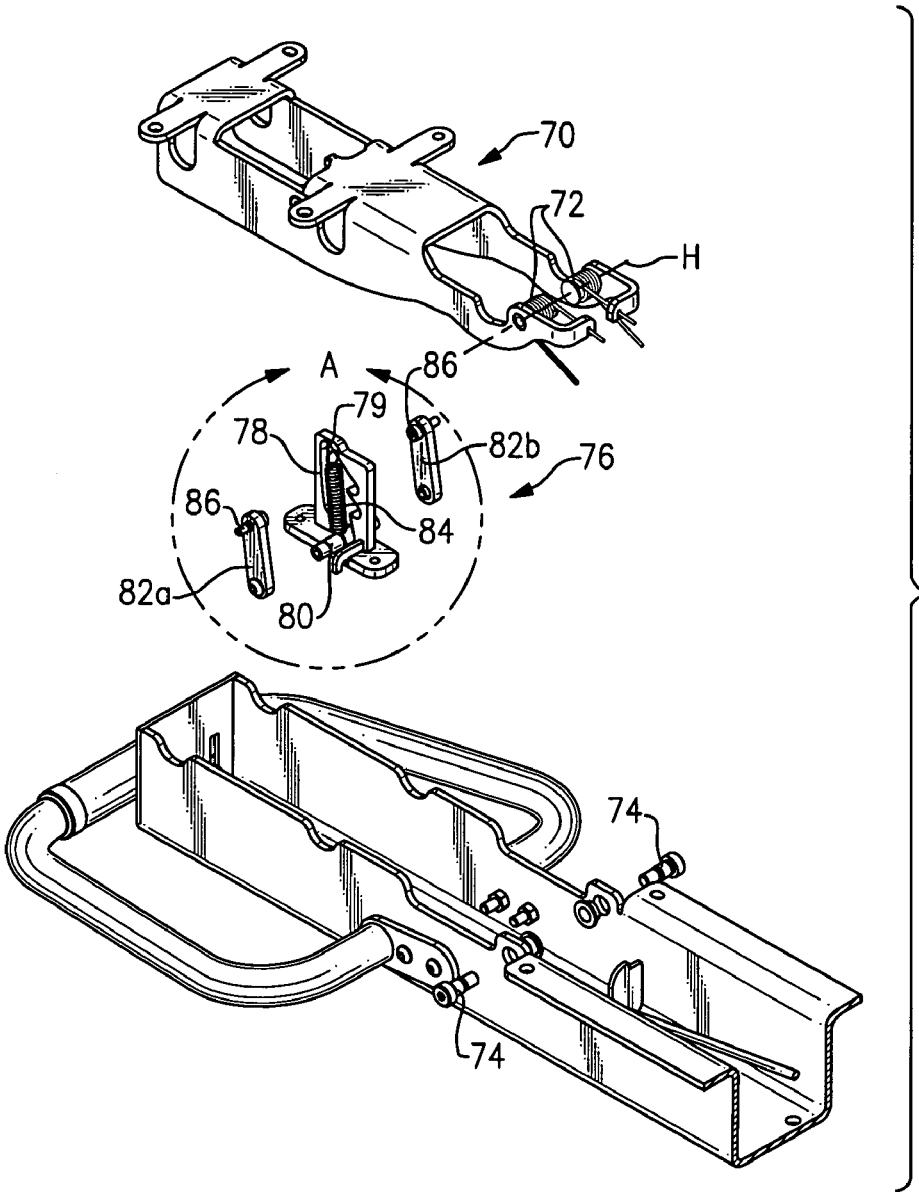
FIG. 7A is an exploded view of the headrest assembly.

Referring to FIG. 7A, movement of the headrest cushion frame 70 is defined by a headrest linkage 76. The headrest linkage 76 generally includes a guide plate 78, a hanging lock pin 80, a pair of support arms 82*a*, 82*b* and a spring 84. The support arms 82*a* and 82*b* are attached to the hanging lock pin 80 at one end and are pivotally mounted to the headrest cushion frame 70 with fasteners 86 at an opposite end to define a headrest linkage pivot axis Hp (FIG. 7B). The spring 84 is mounted to the hanging lock pin 80 and the headrest cushion frame 70 to center bias the hanging lock pin 80 (FIG. 7B). The hanging lock pin 80 extends through an opening 79 of the guide plate 78 to selectively engage a multiple of support detents 86 defined thereby.

Figure 7C:
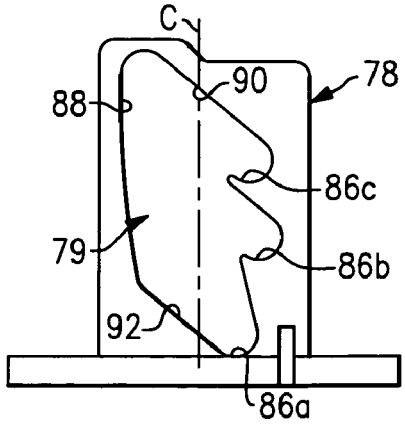
FIG. 7C is a side view of a guide plate of the headrest assembly.
Figure 7B:
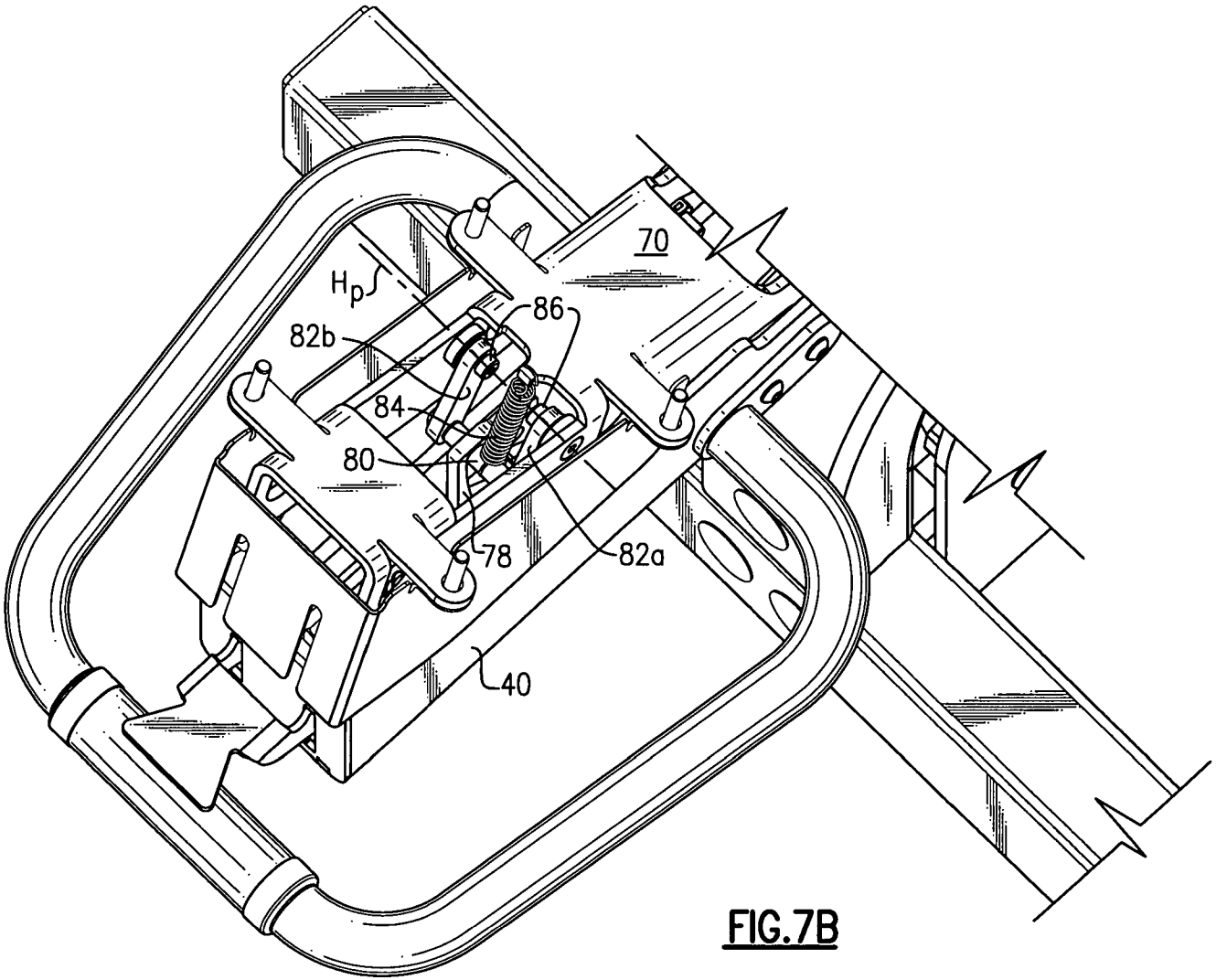
FIG. 7B is an expanded perspective view of the headrest assembly.

Referring to FIG. 7C, the guide plate 78 preferably defines a support detent 86*a* at a 0 degree position, a support detent at an eight (8) degree position 86*b*, and a support detent at a twelve (12) degree position 86*c*. It should be understood that any number of headrest position detents at any desired angle will be usable with the present invention as defined by the guide plate 78. The support detents 86 are located on one side of the opening 79. An opposite side 88 of the opening 79 is preferably straight while an upper surface 90 and a lower surface 92 are sloped toward the support detents 86. Preferably, the lower surface 92 smoothly interfaces with the zero degree support detent 86*a*.

Figure 8A:
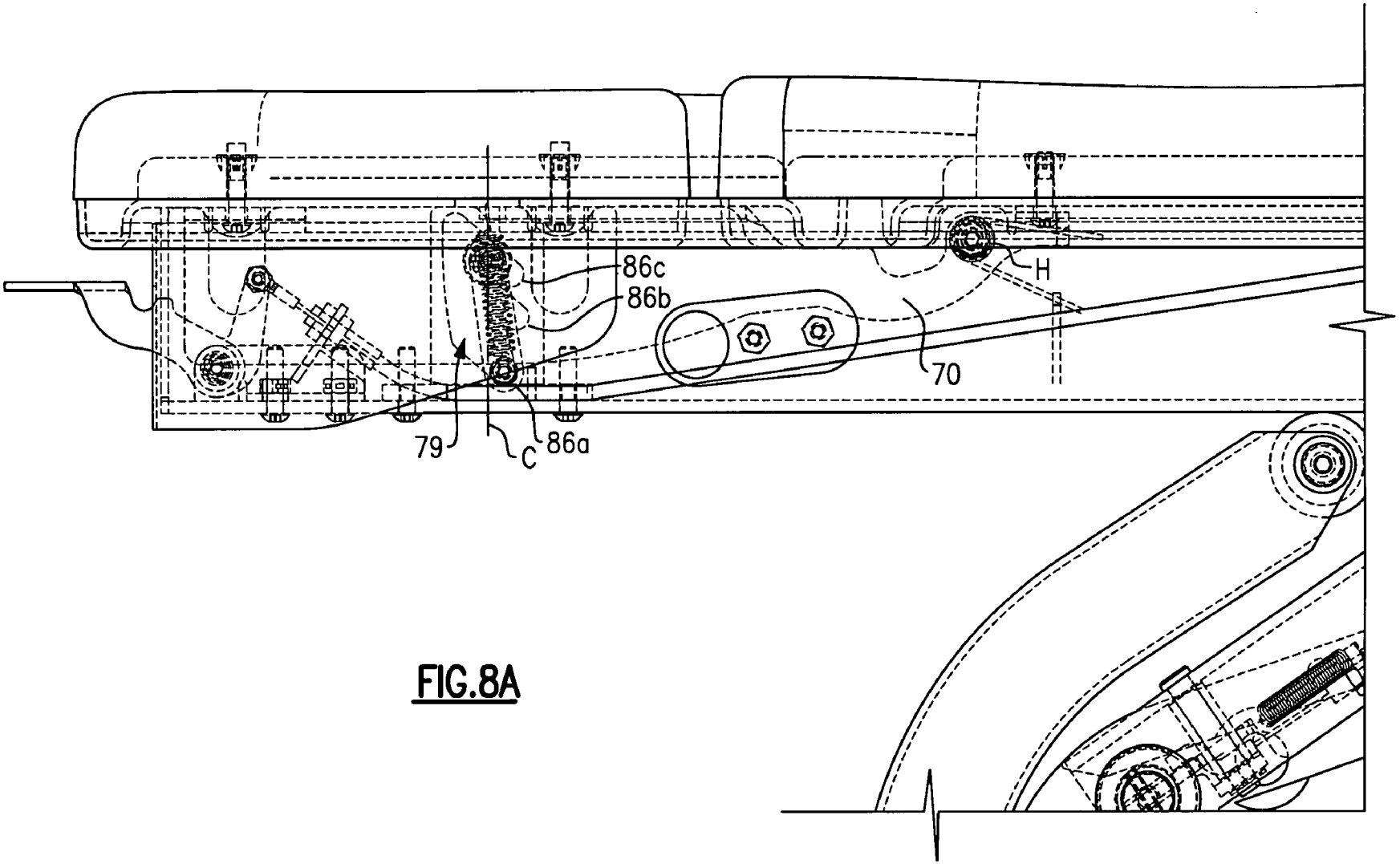
FIGS. 8A-8O show the headrest assembly in various articulated positions.
Figure 8B:
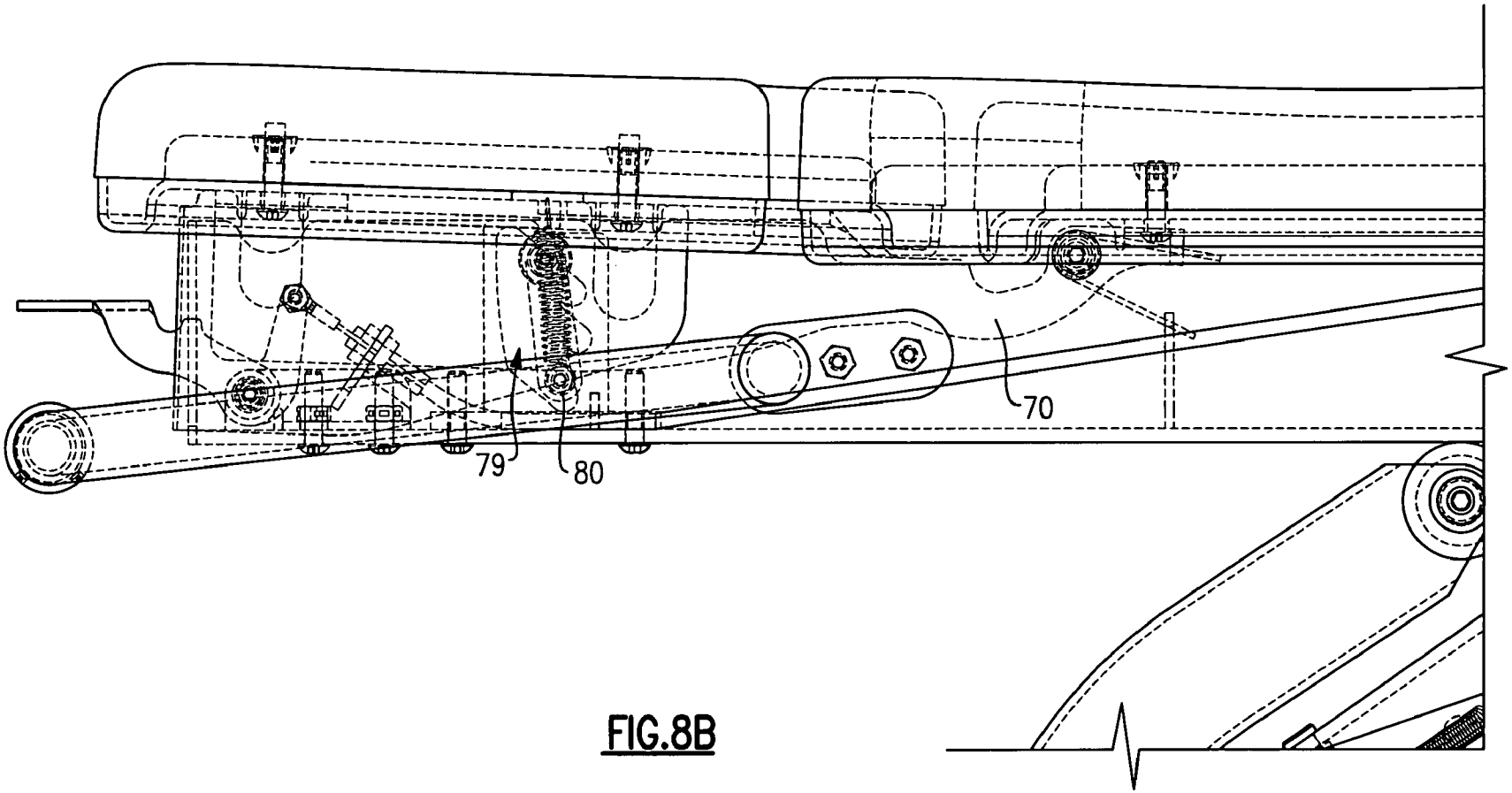
Figure 8C:
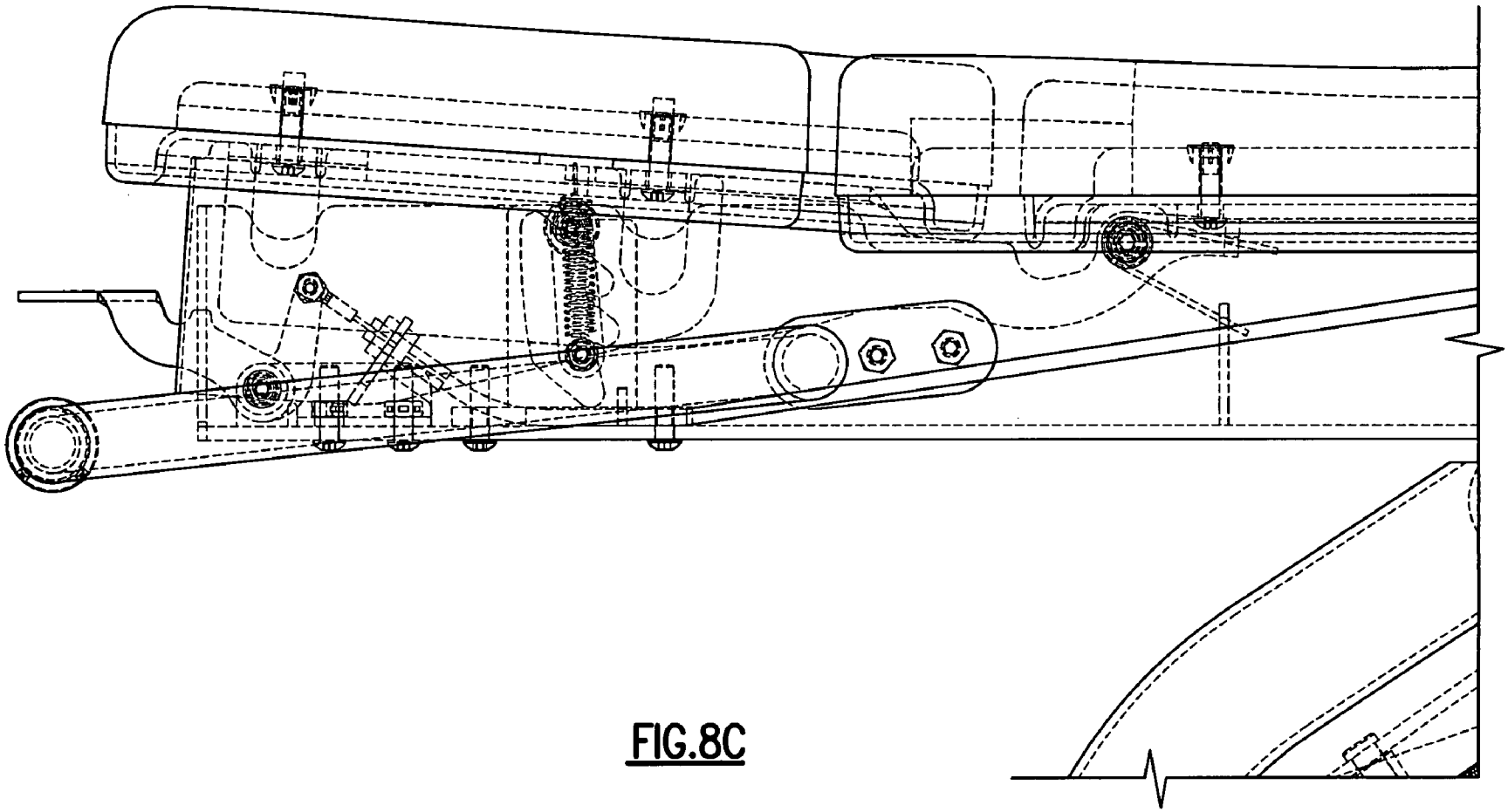
Figure 8D:
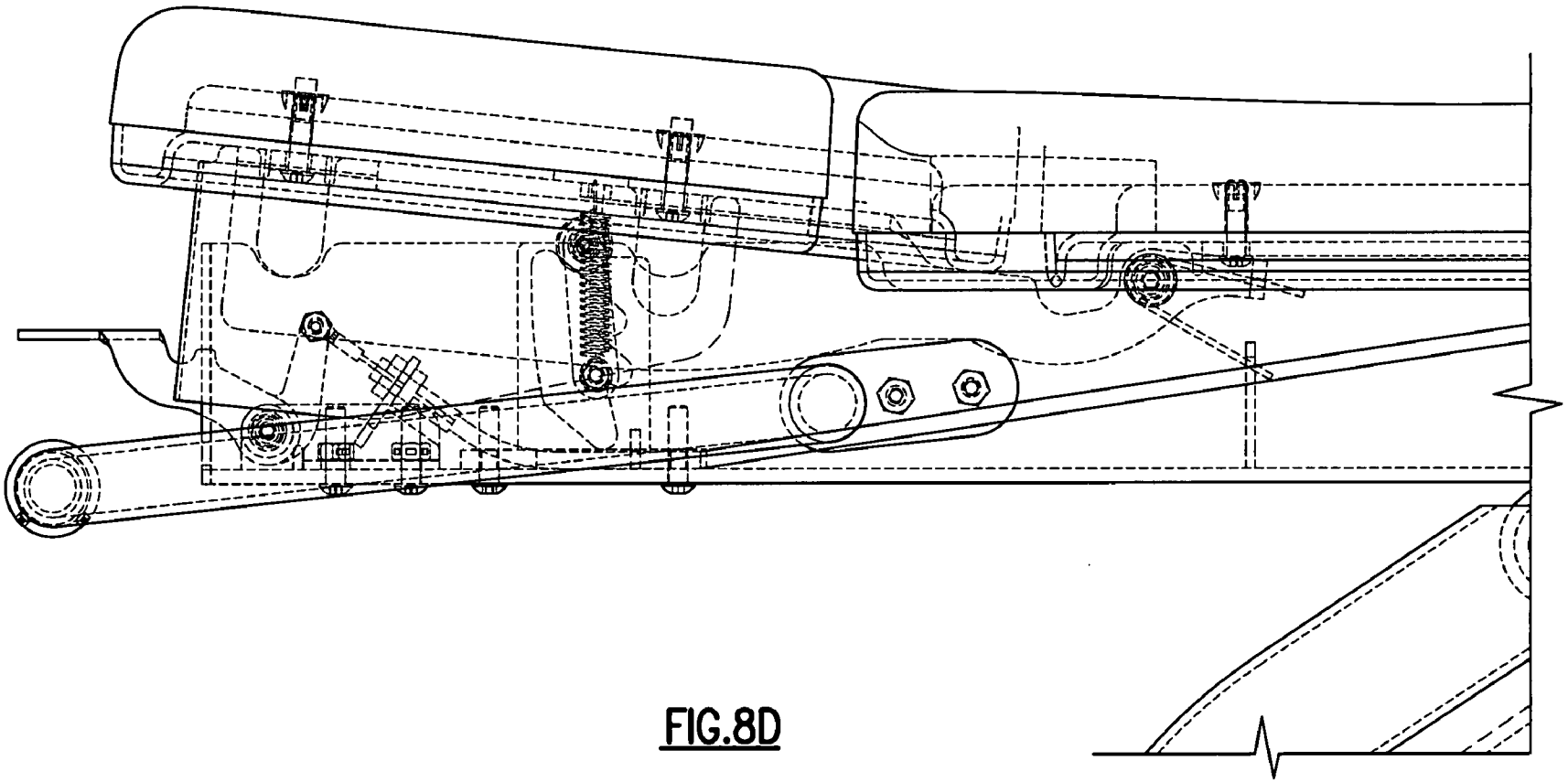
Figure 8E:
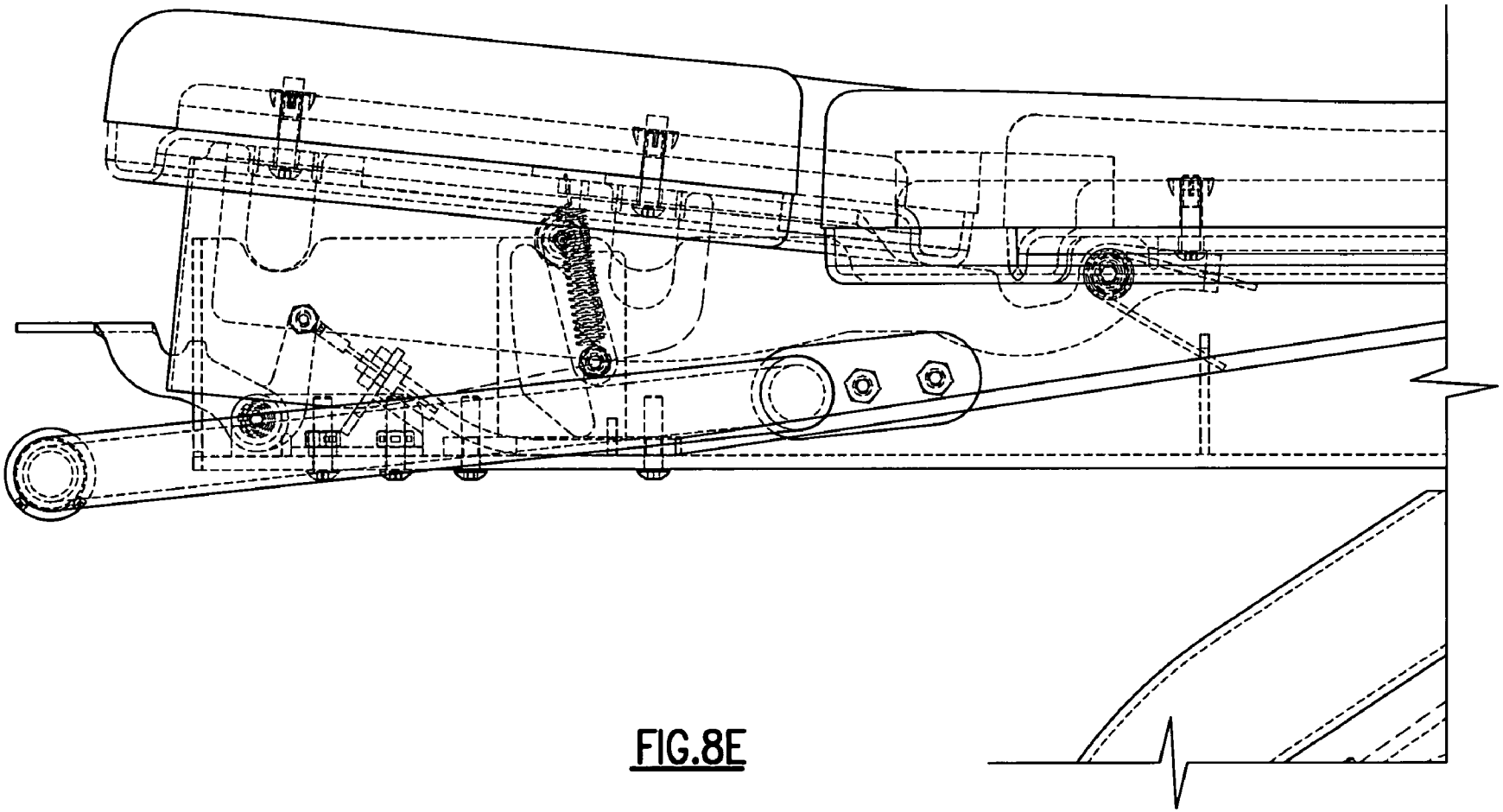
Figure 8F:
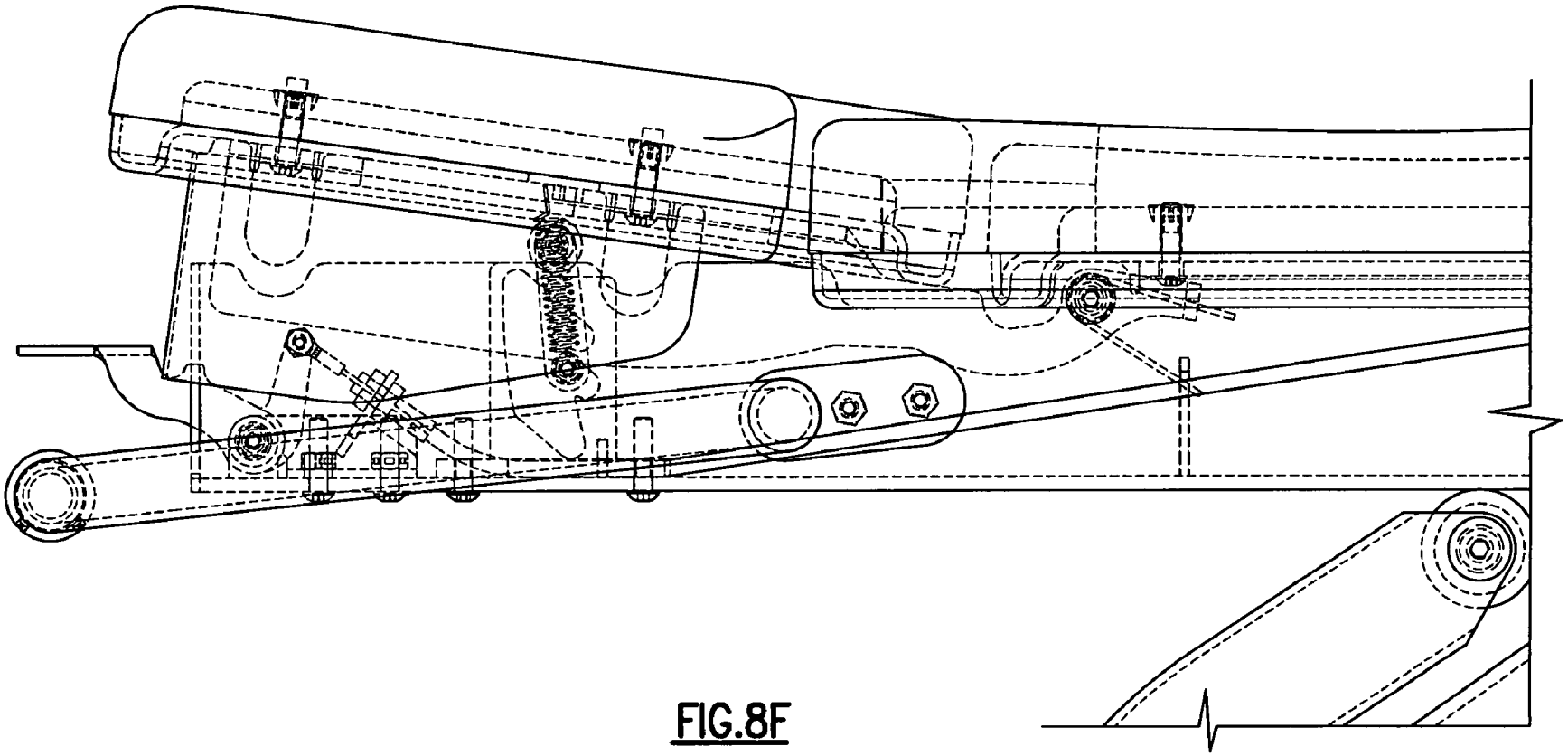
Figure 8G:
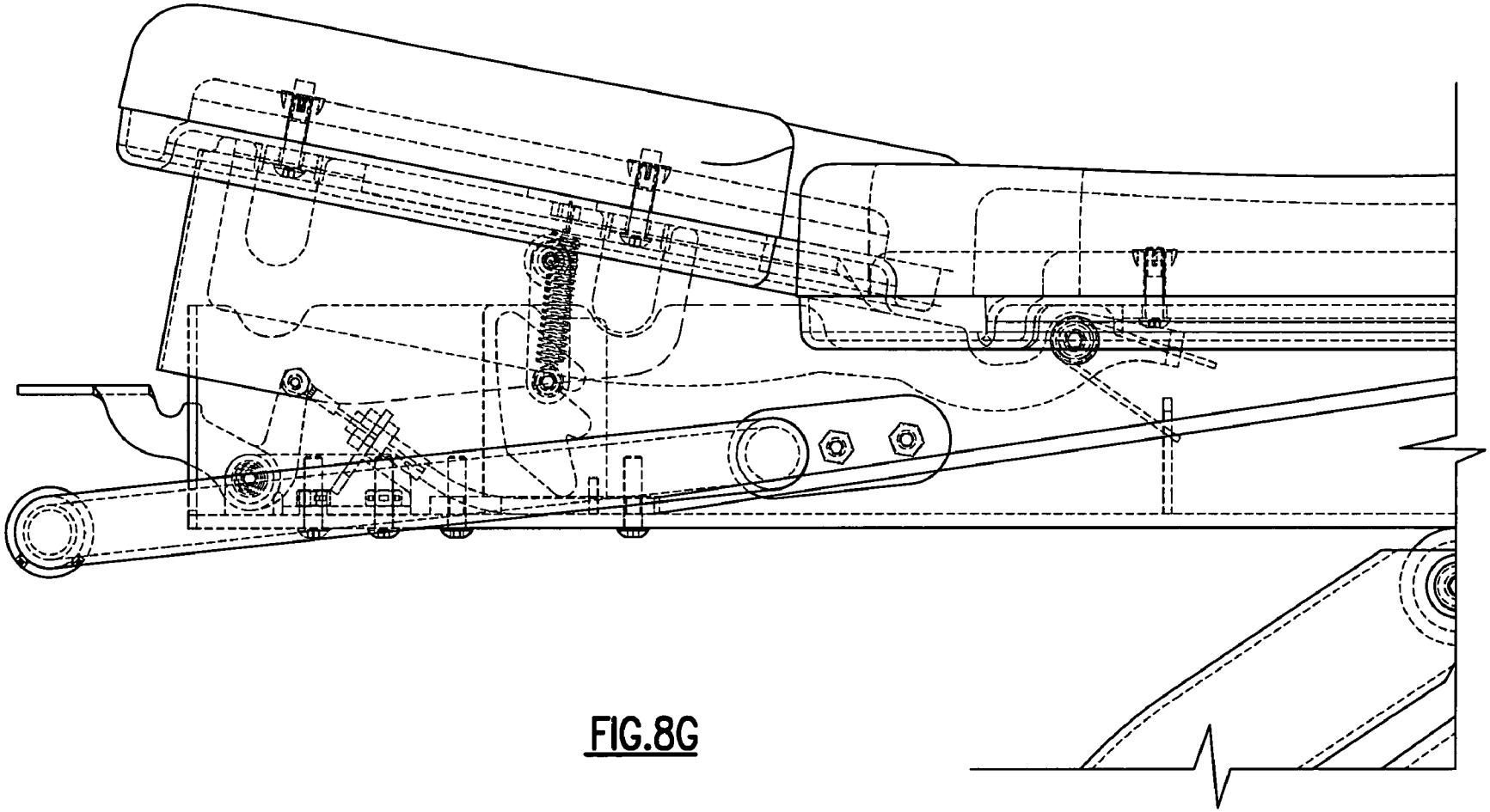
Figure 8H:
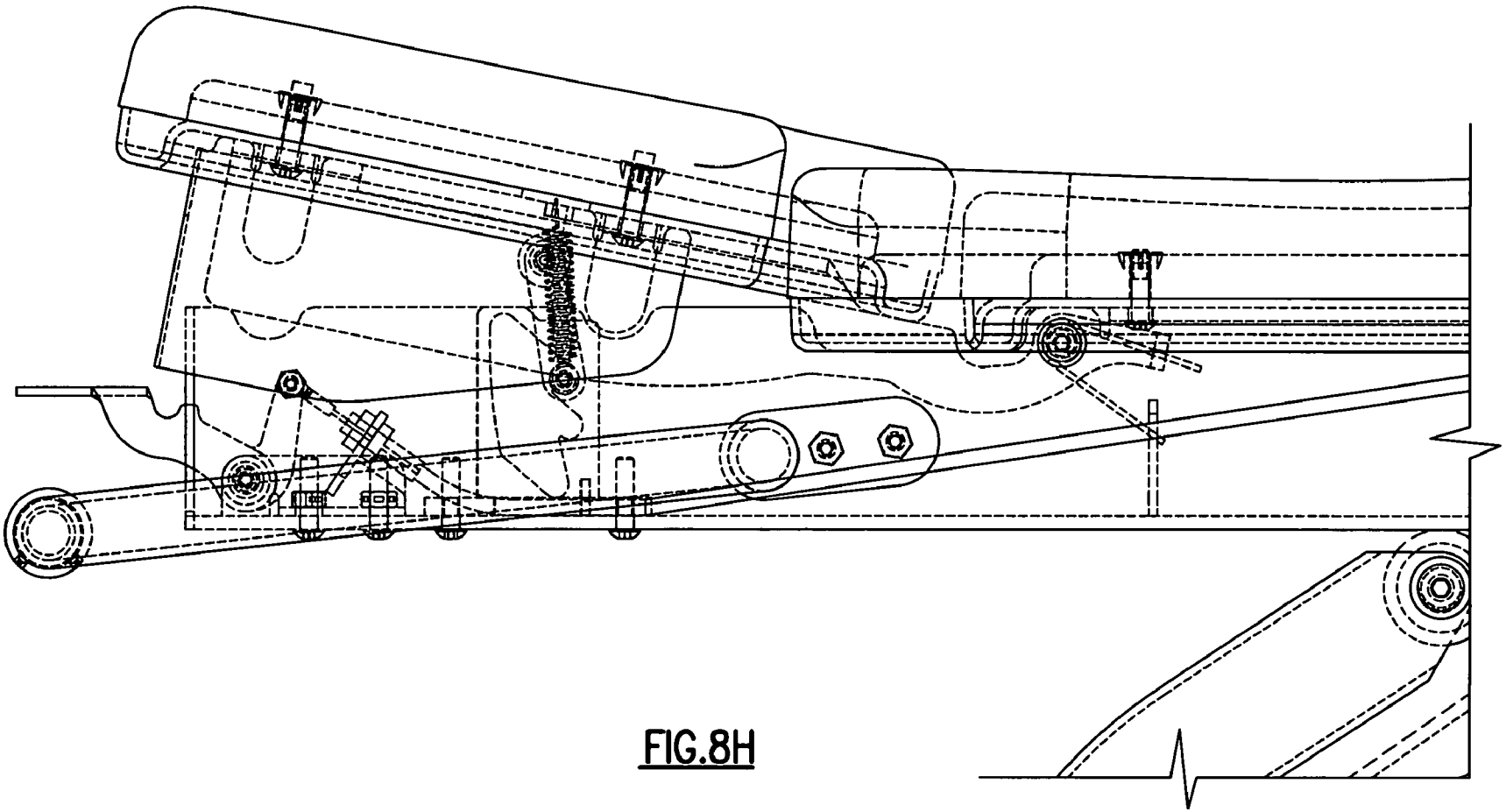

Referring to FIGS. 8A-8O the headrest assembly 16 is supported at the zero (0) degree position (FIG. 8A), the eight (8) degree position (FIG. 8E), and the twelve (12) degree position (FIG. 8H). As the hanging lock pin 80 is center biased by the spring 84 about a center line C (FIG. 7C), the center lock pin 80 is spring biased over the center to the outer periphery of the opening 79 in response to manual movement of the headrest cushion frame 70. In other words, the spring 70 will bias the center lock pin 80 to either the support detents 86 side of the opening or the oppose side 88 depending on which side of the center line C the center lock pin 80 is on as guided by the upper and lower surfaces 90, 92.

Figure 8I:
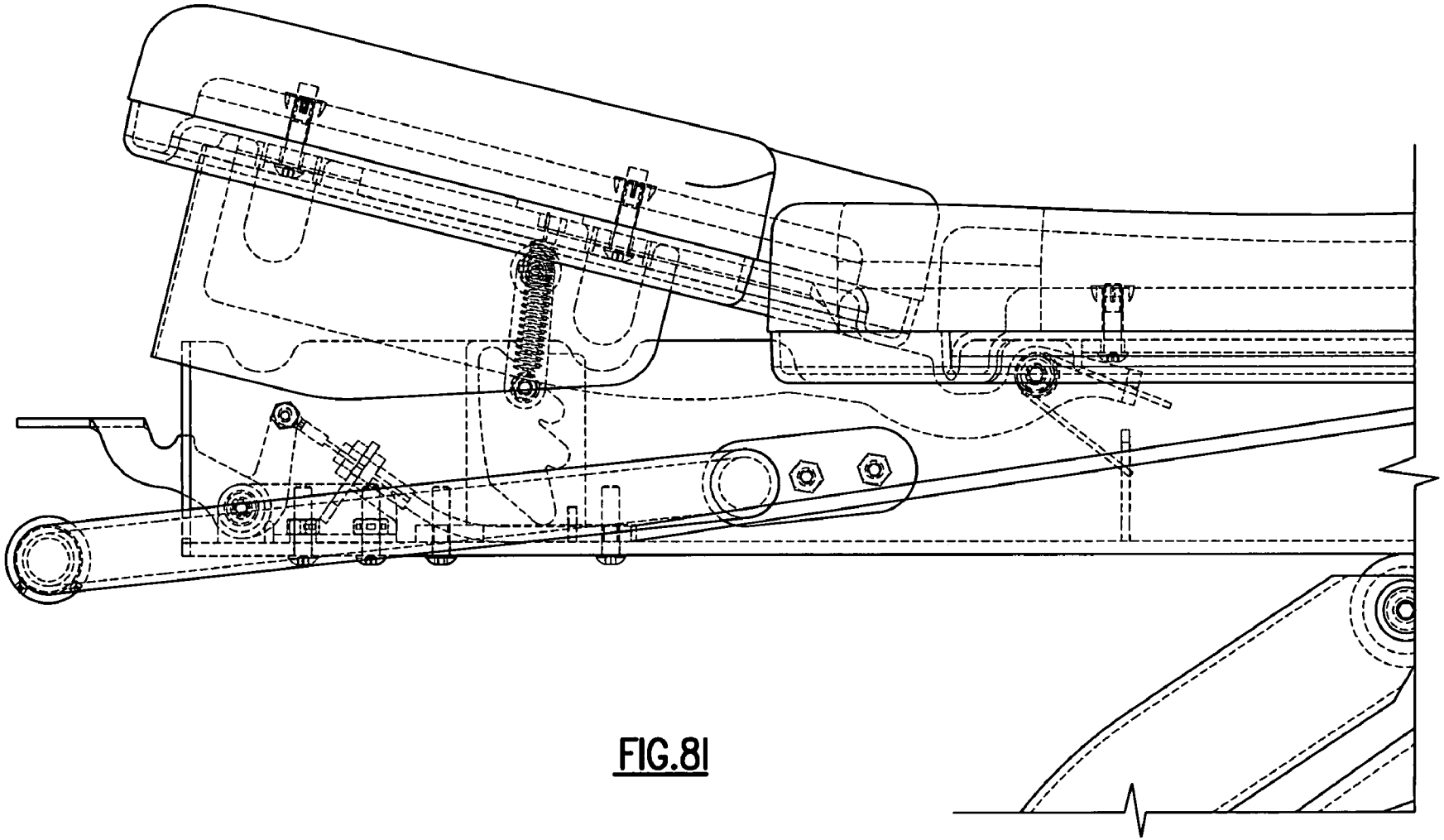
Figure 8J:
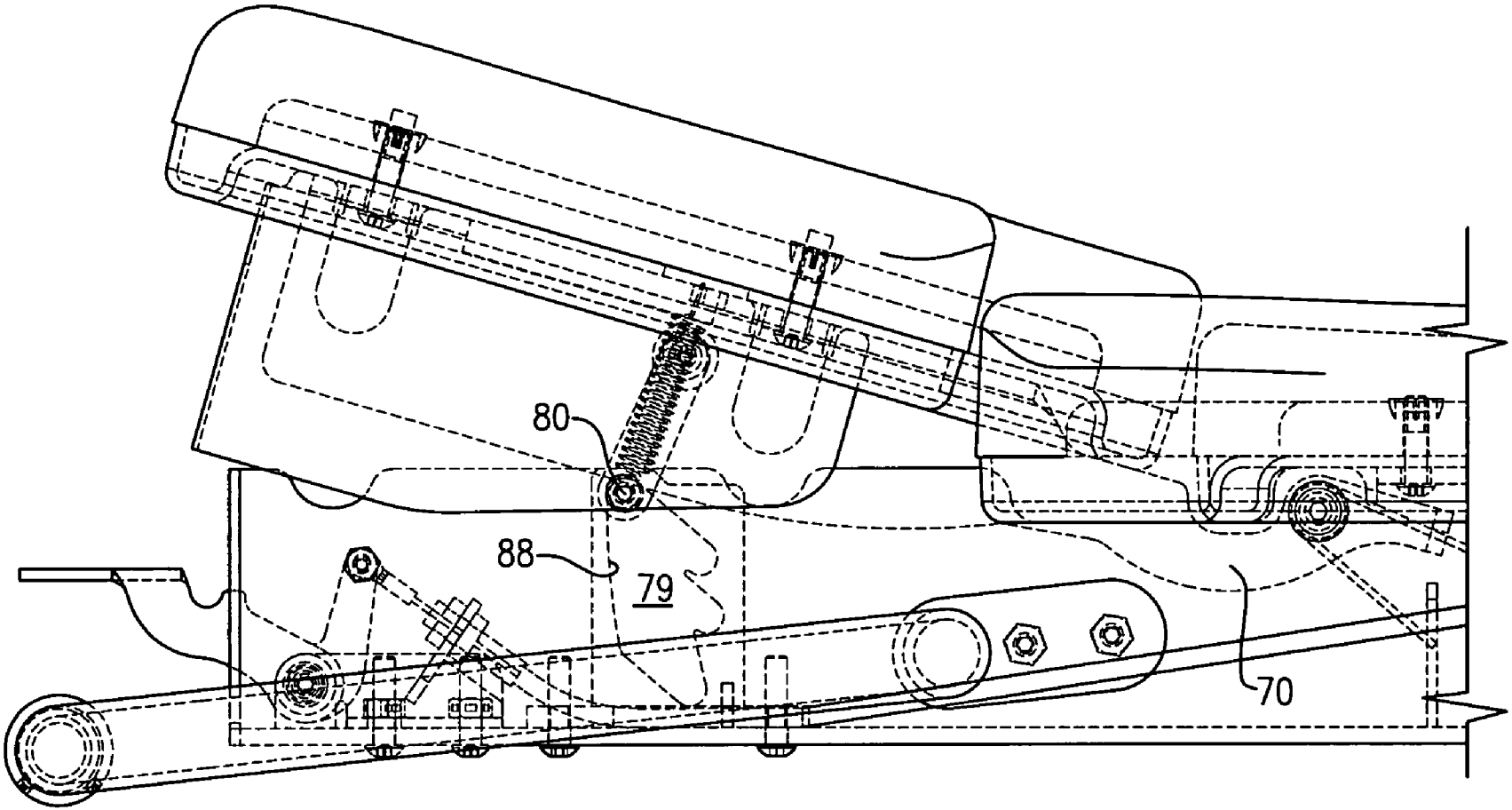
Figure 8K:
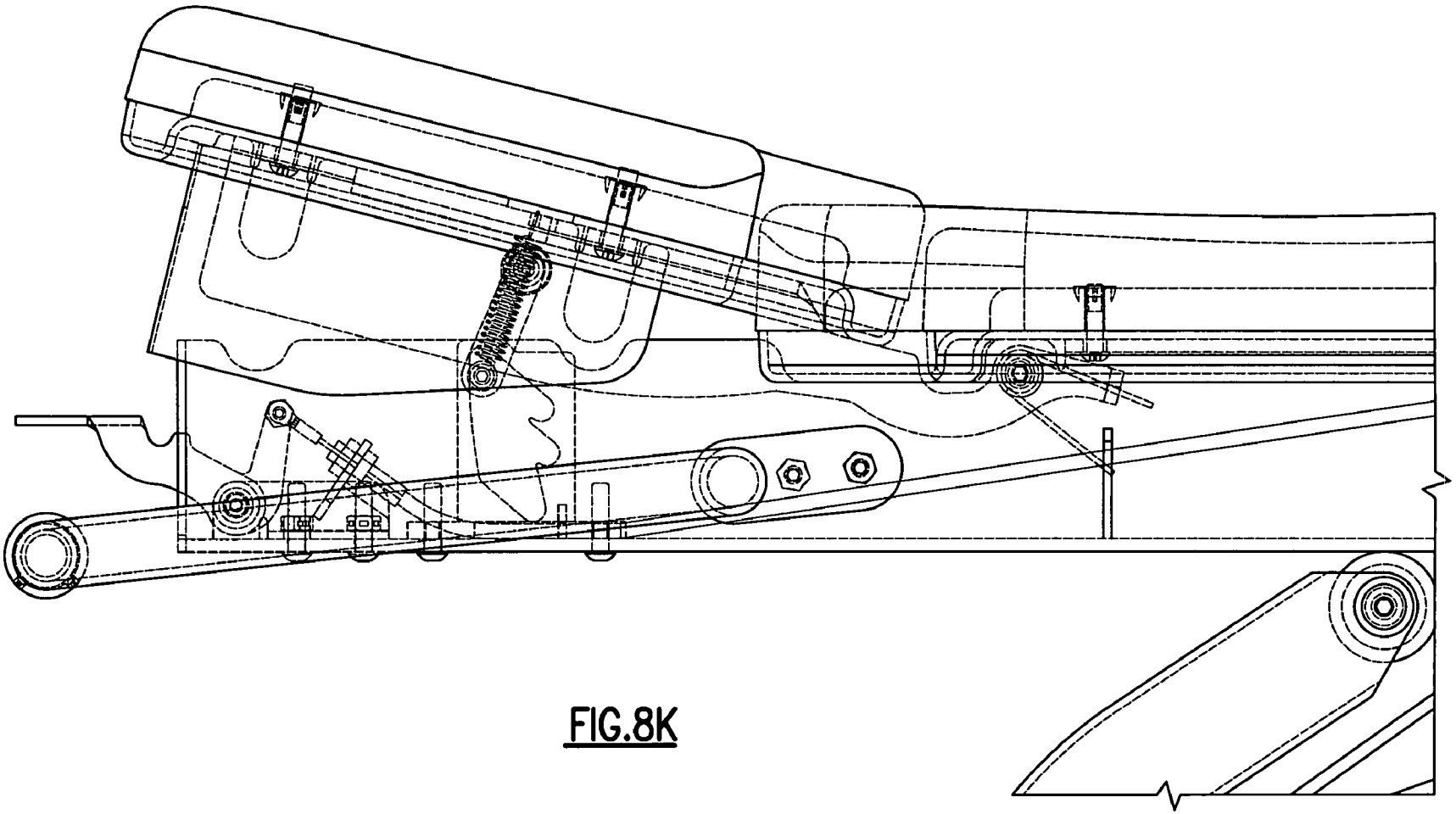
Figure 8L:
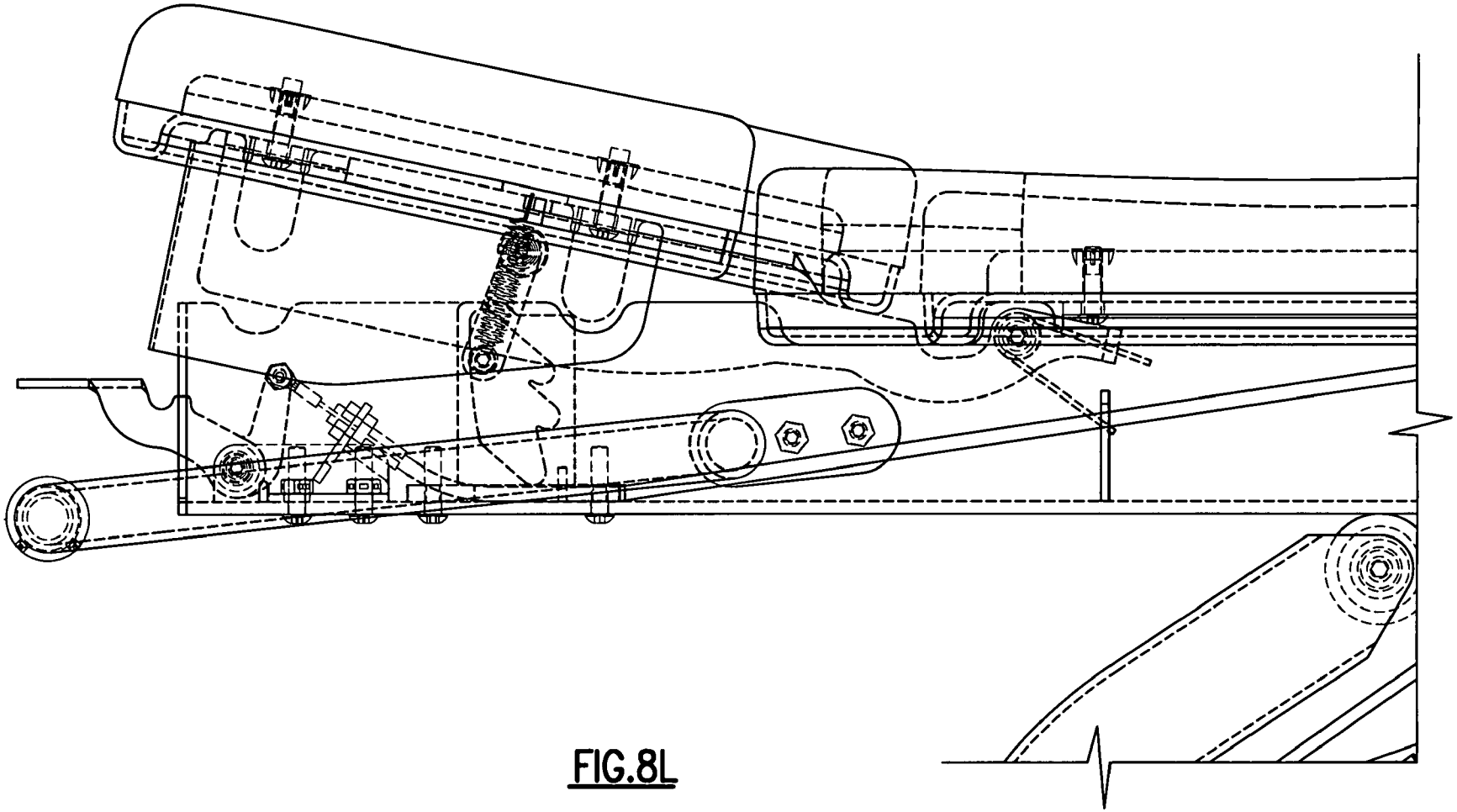
Figure 8M:
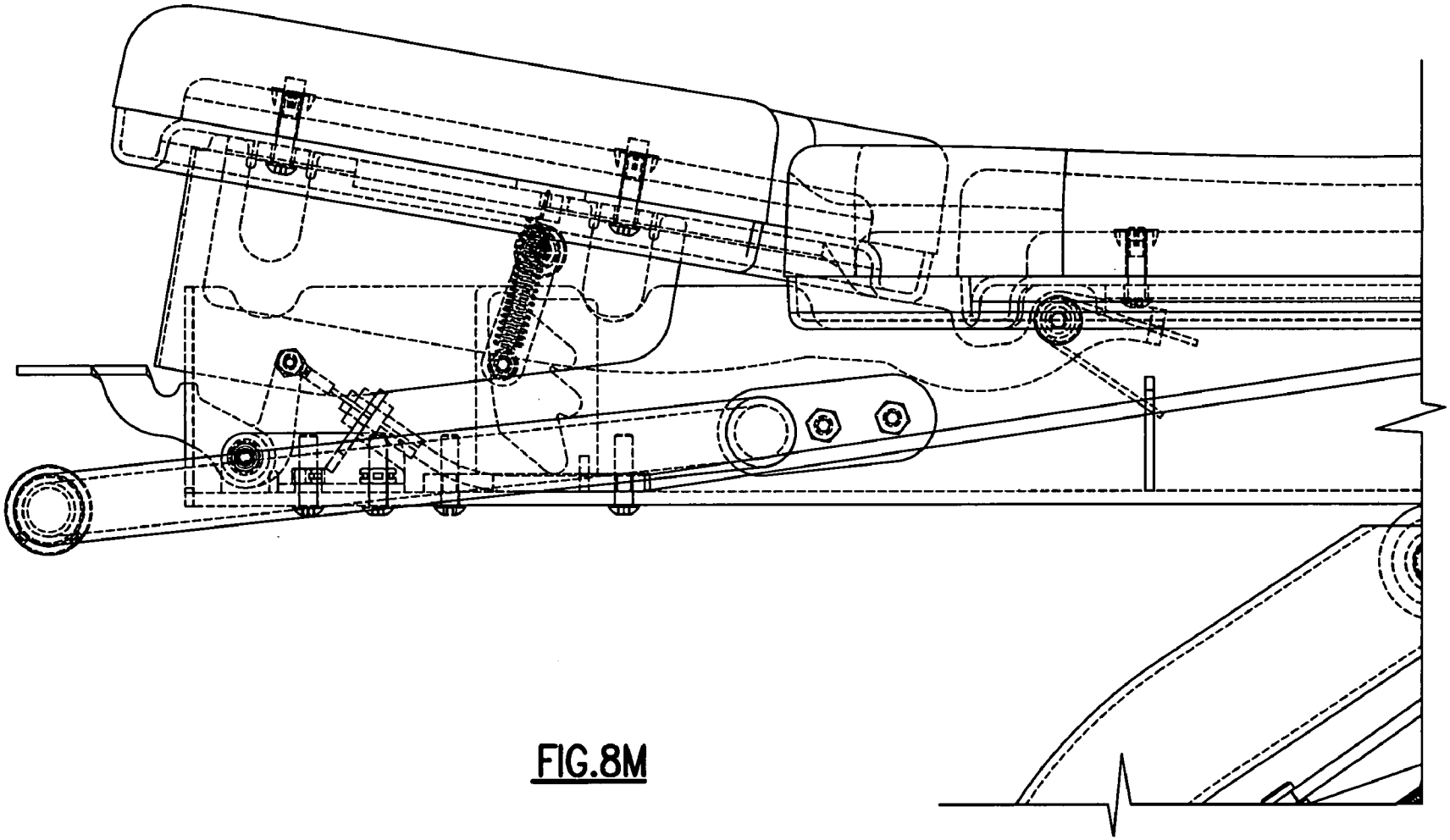
Figure 8N:
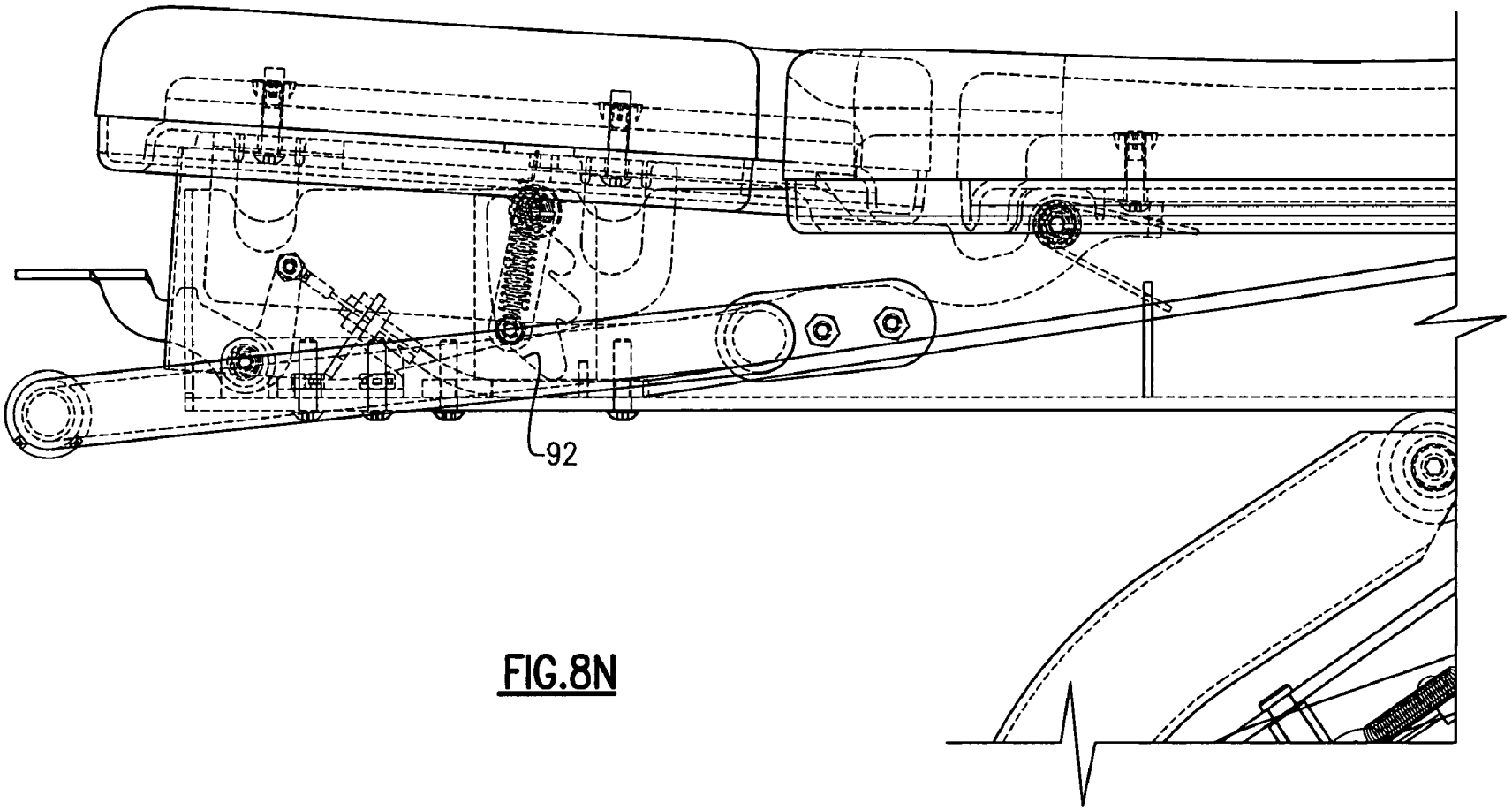
Figure 80:
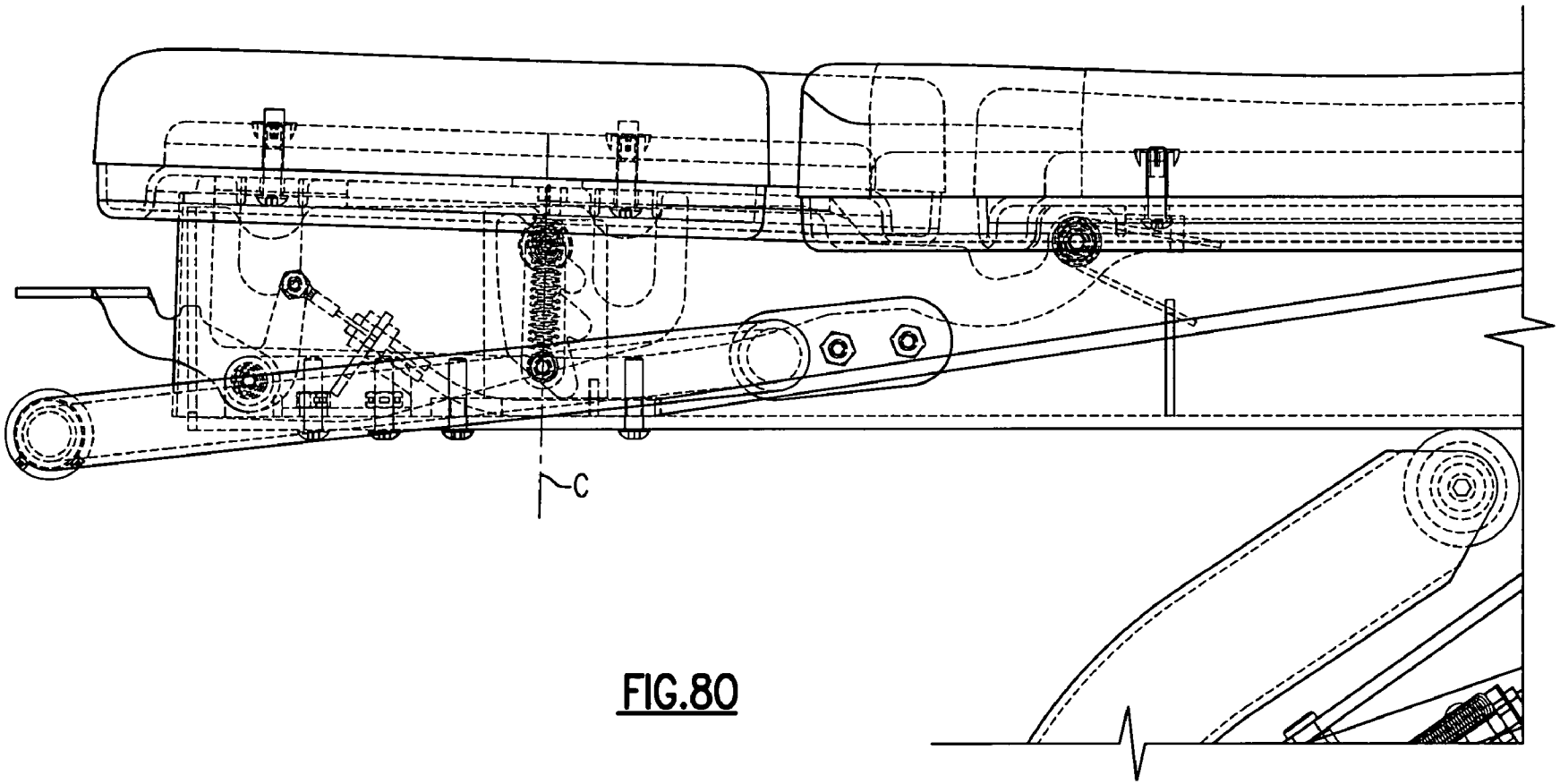

When the headrest cushion frame 70 is raised to the point that the center lock pin 80 reaches the upper surface 90, the center lock pin 80 is driven over center (FIGS. 8I-8J) and is now spring loaded rearward toward the opposite side 88. As the headrest cushion frame 70 is moved to the zero degree position as assisted by the springs 72, the center lock pin 80 is forced forward by the lower surface 92, again driven over center (FIG. 8O-8A) and is now spring loaded forward within the zero degree support detent 86*a* (FIG. 8A).

It should be understood that relative positional terms such as "forward," "aft," "upper," "lower," "above," "below," and the like are with reference to the normal operational attitude and should not be considered otherwise limiting.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. An adjustable headrest assembly for a weight bench system comprising:

a guide plate which defines a guide plate opening with a first side which defines at least one support detent and a second side opposite said first side; and a hanging lock pin which extends through said guide plate opening, said hanging lock pin engageable with said at least one support detent, said hanging lock pin spring loaded to alternate toward either said first side or said second side as the lock pin passes over center.

2. The assembly as recited in claim 1, wherein said guide plate opening includes an upper side sloped downward toward said first side.

3. The assembly as recited in claim 1, wherein said guide plate opening includes a lower side sloped downward toward said first side.

4. The assembly as recited in claim 3, wherein said lower side is sloped downward into a support detent.

5. The assembly as recited in claim 1, wherein said guide plate opening defines a continuous inner perimeter.

6. A weight bench system comprising:

a backrest assembly which supports a generally planar backrest cushion; and a headrest assembly which supports a generally planar headrest cushion articulatably mounted to said backrest assembly, said headrest cushion at least partially recessed into said backrest cushion, said headrest assembly movable between a flat position relative to said backrest assembly and an angled position relative to said backrest assembly.

7. The system as recited in claim 6, further comprising:

a seat assembly; and an intermediate link attached between said seat assembly and said forward backrest link.

8. The system as recited in claim 6, wherein said headrest assembly further comprises:

a guide plate mounted to said backrest assembly, said guide plate defines a guide plate opening with a first side which defines at least one support detent and a second side opposite said first side;

a headrest cushion frame pivotally mounted to said backrest assembly; and a hanging lock pin which pivotally mounted to said headrest cushion frame, said hanging lock pin located through said guide plate opening, said hanging lock plate engageable with said at least one support detent.

9. The system as recited in claim 8, wherein said headrest cushion frame is biased toward said flat position.

10. The system as recited in claim 8, further comprising a spring mounted to said headrest cushion frame and said hanging lock pin, said hanging lock pin spring loaded to alternate toward either said first side or said second side as the lock pin passes over center.

11. The system as recited in claim 8, wherein said guide plate opening defines a continuous inner perimeter.

12. A method of positioning a weight bench seat assembly relative a backrest assembly comprising the steps of:

(A) articulating a backrest assembly;

(B) articulating a seat assembly in response to said step (A), the seat assembly defining a seat pivot axis which transits both forward and aft in response to a unidirectional articulation of the backrest assembly through a range of motion.

13. A method as recited in claim 12, wherein said step (B) further comprising the step of:

(a) transiting the seat pivot axis forward until the backrest assembly obtains an approximately thirty degree position then the seat pivot axis reverses and traverses aft in response to the backrest assembly increasing beyond the approximately thirty degree position.

14. A method as recited in claim 12, wherein said step (B) further comprising the step of:

(a) transiting the seat pivot axis aft until the backrest assembly obtains an approximately thirty degree position then the seat pivot axis reverses and traverses forward in response to the backrest assembly continuing toward a zero degree position.

15. The system as recited in claim 1, wherein said hanging lock pin extends from a headrest assembly pivotally mounted to a backrest assembly, said headrest assembly supports a generally planar headrest cushion.

16. The system as recited in claim 13, wherein said headrest assembly is movable between a multiple of angled positions, each of said positions defined by a support detent.

17. The system as recited in claim 13, wherein said headrest assembly is movable between a zero (0) degree position, an eight (8) degree position, and a twelve (12) degree position, each of said positions, defined by a support detent.

* * * * *

UNITED STATES PATENT AND TRADEMARK OFFICE

CERTIFICATE OF CORRECTION

PATENT NO. : 7,322,912 B2
APPLICATION NO. : 11/326071
DATED : January 29, 2008
INVENTOR(S) : Hockemeyer It is certified that error appears in the above-identified patent and that said Letters Patent is hereby corrected as shown below:

Column 6, line 40: "13" should read as --6--

Column 6, line 43: "13" should read as --6--

Signed and Sealed this

Twentieth Day of May, 2008

JON W. DUDAS
*Director of the United States Patent and Trademark Office*